US009510991B2

(12) United States Patent
Stockmaster et al.

(10) Patent No.: US 9,510,991 B2
(45) Date of Patent: Dec. 6, 2016

(54) MEDICAL REHAB LIFT SYSTEM AND METHOD WITH HORIZONTAL AND VERTICAL FORCE SENSING AND MOTION CONTROL

(71) Applicant: Gorbel, Inc., Fishers, NY (US)

(72) Inventors: James G. Stockmaster, Sodus, NY (US); Brian G. Peets, Fairport, NY (US); Benjamin A. Strohman, Rochester, NY (US); Alexander Z. Chernyak, Pittsford, NY (US); Blake Reese, Honeoye Falls, NY (US); Dean C. Wright, Fairport, NY (US); Yi Luo, Shenzhen (CN); Li-Te Liu, Taipei (TW)

(73) Assignee: Gorbel, Inc., Fishers, NY (US)

( * ) Notice: Subject to any disclaimer, the term of this patent is extended or adjusted under 35 U.S.C. 154(b) by 0 days.

(21) Appl. No.: 14/160,613

(22) Filed: Jan. 22, 2014

(65) Prior Publication Data

US 2014/0206503 A1 Jul. 24, 2014

Related U.S. Application Data

(60) Provisional application No. 61/755,007, filed on Jan. 22, 2013.

(51) Int. Cl.
*A63B 24/00* (2006.01)
*A47D 13/04* (2006.01)
(Continued)

(52) U.S. Cl.
CPC ..... *A61H 3/008* (2013.01); *A61H 2201/1215* (2013.01); *A61H 2201/5038* (2013.01);
(Continued)

(58) Field of Classification Search
USPC ..... 482/1, 4, 6–7, 69, 142–143; 5/81.1 R; 73/379.09, 862.393, 862.392
See application file for complete search history.

(56) References Cited

U.S. PATENT DOCUMENTS 1,961,119 A 5/1934 Ettinger
2,590,739 A 3/1952 Hugo
(Continued)

FOREIGN PATENT DOCUMENTS

| | | |
|---|---|---|
| EP | 2402279 | 4/2012 |
| GB | 1207697 | 10/1970 |
| JP | 11-004858 | 1/1999 |

OTHER PUBLICATIONS

PCT/US14/12434—An International Search Report and Written Opinion dated Jun. 18, 2014 for PCT/US14/12434 filed Jan. 22, 2014: Inventor James G. Stockmaster.
(Continued)

*Primary Examiner* — Oren Ginsberg
*Assistant Examiner* — Shila Jalalzadeh Abyan
(74) *Attorney, Agent, or Firm* — Duane C. Basch; Basch & Nickerson LLP

(57) ABSTRACT

A body-weight support system is disclosed, including an improved lift system and method. The system enables not only the support of patients undergoing rehab therapies, but including exercise modes that are both customizable and dynamic in nature, as well as a track system, wherein the system is capable of providing alternative functionality at differing locations. Other features disclosed include a system by which a movable support unit tracks or follows a patient, adjustable and variable supportive forces for users based upon, for example, a percentage of sensed body weight, and a user-interface that may be employed in a mobile, wired or wireless manner and will allow the use of multiple lift systems on a single, looped track system.

18 Claims, 24 Drawing Sheets

(51) Int. Cl.
*A63B 26/00* (2006.01)
*A63B 71/00* (2006.01)
*A63B 15/02* (2006.01)
*A61H 3/00* (2006.01)

(52) U.S. Cl.
CPC ..... *A61H2201/5043* (2013.01); *A61H 2201/5061* (2013.01); *A61H 2201/5092* (2013.01); *A61H 2201/5097* (2013.01)

(56) References Cited

U.S. PATENT DOCUMENTS 3,222,029 A 12/1965 Hildemann
3,330,154 A * 7/1967 Habern ..... B66D 1/50 73/862.393
3,654,922 A 4/1972 Outcalt
3,699,809 A * 10/1972 Komatsu ..... B65H 63/04 242/421
4,106,335 A * 8/1978 Shatto ..... B63G 8/42 73/170.32
D269,701 S 7/1983 Miller
4,602,619 A 7/1986 Wolf
D285,137 S 8/1986 Svensson
4,607,625 A 8/1986 Schenck
4,776,581 A 10/1988 Shepherdson
4,907,571 A * 3/1990 Futakami ..... A61H 3/008 482/69
4,981,307 A 1/1991 Walsh
5,054,137 A 10/1991 Christensen
5,190,507 A * 3/1993 Iijima ..... A61H 3/008 482/69
D372,982 S 8/1996 Williams
5,850,928 A * 12/1998 Kahlman ..... B66C 13/22 212/285
5,893,367 A 4/1999 Dubats et al.
6,079,578 A * 6/2000 Dyson ..... A61G 7/1015 104/89
6,135,928 A * 10/2000 Butterfield ..... G06F 3/011 482/66
6,204,620 B1 3/2001 McGee et al.
6,269,944 B1 * 8/2001 Taylor ..... B66C 7/02 104/108
6,313,595 B2 11/2001 Swanson et al.
6,315,138 B1 11/2001 Dyson
6,464,208 B1 10/2002 Smith
6,612,449 B1 9/2003 Otani et al.
6,668,668 B1 * 12/2003 Peshkin ..... B66C 13/18 324/207.15
6,738,691 B1 5/2004 Colgate et al.
6,813,542 B2 11/2004 Peshkin et al.
6,907,317 B2 6/2005 Peshkin et al.
6,928,336 B2 8/2005 Peshkin et al.
7,043,337 B2 5/2006 Colgate et al.
7,120,508 B2 10/2006 Peshkin et al.
7,185,774 B2 3/2007 Colgate et al.
7,298,385 B2 11/2007 Kazi et al.
7,381,163 B2 * 6/2008 Gordon ..... A63B 22/02 482/69
7,461,753 B1 * 12/2008 Gatta ..... B66D 3/18 212/331
7,526,847 B1 5/2009 Arthur et al.
7,608,847 B2 10/2009 Rees
7,756,601 B1 7/2010 Van Dyke et al.
7,832,711 B2 * 11/2010 Miyoshi ..... B66C 23/18 212/285
7,883,450 B2 * 2/2011 Hidler ..... A61H 3/008 212/104
7,973,299 B2 7/2011 Rees
8,221,293 B2 * 7/2012 Hoffman ..... A63B 21/4009 482/51
8,844,904 B2 * 9/2014 Bogh-Sorensen ... A61G 7/1042 16/430
2001/0027149 A1 * 10/2001 Bingham ..... A47D 13/046 482/69
2002/0066711 A1 * 6/2002 Taylor ..... B66C 13/063 212/285
2002/0100642 A1 * 8/2002 Mehrman ..... A63G 31/00 185/14
2003/0057408 A1 * 3/2003 Kazerooni ..... B66D 3/18 254/270
2003/0153438 A1 8/2003 Gordon et al.
2006/0229164 A1 * 10/2006 Einav ..... A63B 21/00 482/9
2007/0004567 A1 * 1/2007 Shetty ..... A61H 3/008 482/69
2008/0287268 A1 * 11/2008 Hidler ..... A61H 3/008 482/69
2009/0215588 A1 * 8/2009 Riener ..... A61H 1/0237 482/7
2010/0137772 A1 6/2010 Tanaka et al.
2011/0100249 A1 * 5/2011 Ipsen ..... A61G 7/1042 104/108
2012/0018249 A1 * 1/2012 Mehr ..... A63B 69/0064 182/5
2013/0153334 A1 * 6/2013 Crew ..... E06C 7/12 182/18
2015/0320632 A1 * 11/2015 Vallery ..... A61H 3/008 482/69

OTHER PUBLICATIONS

PCT/US2016/016414 An International Search Report and Written Opinion dated Jun. 2, 2016 for PCT/US2016/016414 filed Feb. 3, 2016, Inventor James G. Stockmaster et al.
EP14742789.2—A European Search Report and Search Opinion dated Jul. 4, 2016.

* cited by examiner

MEDICAL REHAB LIFT SYSTEM AND METHOD WITH HORIZONTAL AND VERTICAL FORCE SENSING AND MOTION CONTROL

This application claims priority under 35 U.S.C. §119 from U.S. Provisional Application No. 61/755,007 for a MEDICAL REHAB LIFT SYSTEM AND METHOD WITH HORIZONTAL AND VERTICAL FORCE SENSING AND MOTION CONTROL, filed Jan. 22, 2013 by James Stockmaster et al., which is hereby incorporated by reference in its entirety.

The system disclosed herein relates to a body-weight support system, and more particularly to an improved support system, and method including exercise modes that are customizable or configurable and dynamic in nature, and which may include loops and a track system, where the system is capable of providing alternative functionality at differing locations, an adjustable and variable supportive force for users based upon, for example, a percentage of sensed body weight. The disclosed system further provides a user-interface that may be employed in a fixed, mobile, wired or wireless manner, and will enable the use of multiple lifts on a single track system.

BACKGROUND AND SUMMARY

The process of providing rehabilitative services and therapy to individuals with significant walking deficits and other physical impairments presents a challenge to even the most skilled therapists. For example, patients suffering from neurological injuries such as stroke, spinal cord injury, or traumatic brain injury often exhibit an inability to support themselves, poor endurance or walking patterns that are unstable. Such deficiencies make it difficult, at best, for the patient and therapist to engage in particular exercises, therapies, etc. Accordingly, it is increasingly common for such therapies to involve some sort of body-weight support system to reduce the likelihood of falls or other injuries, while enabling increased intensity or duration of the training or therapy.

Some existing support systems obstruct a therapist's interaction with the patient, by presenting barriers between the patient and the therapist. Other stand-alone support systems require assistance, or the patient, to manage the horizontal movement of the support system, rather than focusing on their own balance and preferred form of the therapy. In other words, the patient may be forced to compensate for the dynamics of the support system. Such a confounding effect could result in the patient's development of abnormal compensatory movements that persist when the patient is removed from the support system.

Yet a further problem with some systems is that under static unloading, the length of the supporting straps is set to a fixed length, so the subject either bears all of their weight when the straps are slack or no weight when the straps are taught. Static unloading systems are known to produce abnormal ground reaction forces and altered muscle activation pattern. Moreover, static unloading systems may limit the patient's vertical excursions (e.g., up and over steps, stairs and the like) and thereby prevent certain therapies where a large range of motion is required. Another problem observed with systems that are programmed to follow the patient's movement are significant delays in the response of the system (often the result of mechanics of sensors, actuators and system dynamics), where the patient feels that they are exerting greater force than necessary just to overcome the support system—resulting in the patient learning adaptive behaviors that may destabilize impaired patients when they ultimately begin self-supported activities for which they are being trained.

In light of the current body-weight support systems there is a need for a medical rehab support system and method that overcomes the limitations of the systems characterized above.

Disclosed in embodiments herein is a body-weight support system having an improved support system and method including exercise modes that are customizable or configurable and dynamic in nature, include loops and a track system, wherein the system is capable of providing alternative functionality at differing locations, an adjustable and variable supportive force for users based upon, for example, a percentage of sensed body weight. The disclosed system further provides a user-interface that may be employed in a fixed, mobile, wired or wireless manner, and the system will allow the use of multiple units on a single, possibly looped, track without collision or interference between adjacent units.

Further disclosed in embodiments herein is a system for supporting the weight of a person, comprising: a track including an indexed portion thereon (could also be supported by an arm or a gantry with ability to programmatically define a path over which the gantry trolley can move); a movable support operatively attached to the track, the support being movable along a path defined by the track and in a first direction and in a second direction generally opposite to the first direction; a first drive attached to the movable support, said first drive moving the support along the path defined by the track, wherein the first drive is operatively coupled to the indexed portion on the track to reliably control the horizontal position of the support along the track; an actuator attached to the movable support, said actuator including a second drive for driving a rotatable drum, said drum having a first end of a strap (or other flexible, braided member) attached thereto and the strap wound about an outer surface of the drum, with a second end of the strap being coupled to a support harness (or similar supportive/assistive device) attached to support a person; a first sensor for detecting a horizontal force applied to the support via the strap; a second sensor for sensing a vertical force applied to the strap; and a control system configured to receive signals from the first and second sensors and a user interface and to control the movement of at least the first and second drives to facilitate the support and movement of the person, where the control system dynamically adjusts the amount of support provided to the person by altering at least the vertical force applied to the strap via the drum and second motor.

Also disclosed in embodiments herein is a system for supporting the weight of a person, comprising: a track including a plurality of extruded members joined end-to-end, and a plurality of electrical rails arranged longitudinally along an interior portion of the track for each portion of track, wherein at least one extruded member includes a generally planar upper surface extending in a longitudinal direction, opposing sides extending longitudinally and downward from each side of the upper surface, and where a combination the upper surface and downward-extending sides form the interior portion of the track; each of said opposing sides further including a shoulder extending in an outward direction therefrom; a movable support unit operatively attached to the track, the movable support unit being movable along a path defined by the track in a first direction and in a second direction generally opposite to the first direction; a first drive attached to the movable support unit, said first drive moving the support along the path defined by the track, wherein the first drive is frictionally coupled to a surface of the track to control the horizontal position of the support along the track, wherein said first drive is maintained in frictional contact with the interior portion of the track and where the movable support unit is suspended from rollers resting on each of the shoulders extending from the opposing sides of the track; an actuator attached to the movable support unit, said actuator including a second drive for driving a rotatable drum, said drum having a first end of a strap attached thereto and the strap wound in an overlapping coil fashion about an outer surface of the drum, and a second end of the strap being coupled to a support harness attached to support a person; a first sensor for detecting a horizontal force applied to the movable support unit via the strap, including a strap guide operatively attached to and extending from said movable support unit, said strap guide being attached to a load cell in a manner causing a change in the load cell output when the strap is pulled in a direction forward from or backward from vertical; a second sensor for sensing a vertical force applied to the strap, including at least one pulley between the drum and the person supported by the strap, wherein the pulley is connected on one end of a pivoting arm, said arm being pivotally attached near its midsection to a frame member coupled to the movable support, and where an opposite end of said pivoting arm is operatively associated with a load cell such that the load cell is placed only in compression in response to a load suspended on the strap; and a control system configured to receive signals from the first and second sensors, and a user interface, and to control the movement of at least the first and second drives to facilitate the support during movement of the person, where the control system dynamically adjusts the amount of support provided to the person by moving the moveable support unit horizontally along the track to follow the person, thus minimizing the effect on the person, and by altering the vertical force applied to the person via the strap, the drum and second motor, to be suitable for a given patient.

Further disclosed in embodiments herein is A method for supporting the weight of a person for purposes of rehabilitation therapy, comprising: providing a track, the track including a plurality of extruded members joined end-to-end, and a plurality of electrical rails arranged longitudinally along an interior portion of the track for each portion of track, wherein at least one extruded member includes a generally planar upper surface extending in a longitudinal direction, opposing sides extending longitudinally and downward from each side of the upper surface, and where a combination the upper surface and downward-extending sides form the interior portion of the track; each of said opposing sides further including a shoulder extending in an outward direction therefrom; operatively attaching a movable support unit to the track, the movable support unit being movable along a path defined by the track in a first direction and in a second direction generally opposite to the first direction; moving the support unit along the path defined by the track using a first drive attached to the movable support unit, wherein the first drive is operatively coupled to a surface of the track to control the horizontal position of the support along the track, and where the movable support unit is suspended from rollers resting on each of the shoulders extending from the opposing sides of the track; controlling the vertical position of the person using an actuator attached to the movable support unit, said actuator including a second drive for driving a rotatable drum, said drum having a first end of a strap attached thereto and the strap wound in an overlapping coil fashion about an outer surface of the drum, and a second end of the strap being coupled to a support harness attached to support the person; detecting a horizontal force applied to the movable support unit via the strap using a first sensor, the first sensor including a strap guide operatively attached to and extending from the movable support unit, the strap guide being attached to a load cell in a manner causing a change in the load cell output when the strap is pulled in a direction forward from or backward from vertical; sensing a vertical force applied to the strap using a second sensor, the second sensor including at least one pulley between the drum and the person supported by the strap, wherein the pulley is connected on one end of a pivoting arm, said arm being pivotally attached near its midsection to a frame member coupled to the movable support, and where an opposite end of said pivoting arm is operatively associated with a load cell such that the load cell is placed only in compression in response to a load suspended on the strap; and providing a control system configured to receive signals from the first and second sensors, and a user interface, and to control the movement of at least the first and second drives to facilitate and support movement of the person, where the control system dynamically adjusts the amount of support provided to the person by moving the moveable support unit horizontally along the track to follow the person.

Figure 1:
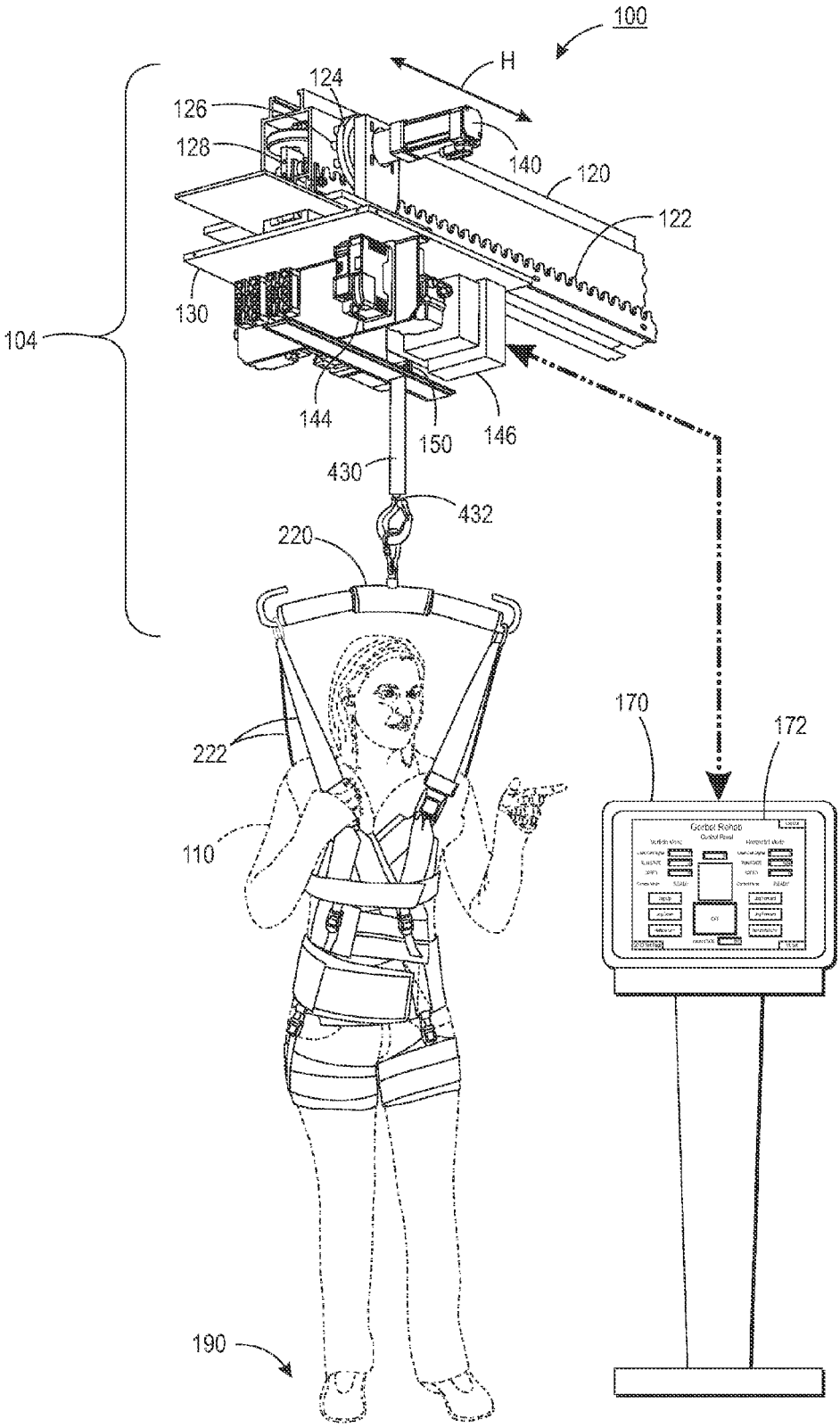
FIG. 1 is a representation of an exemplary rehab support system.
Figure 2:
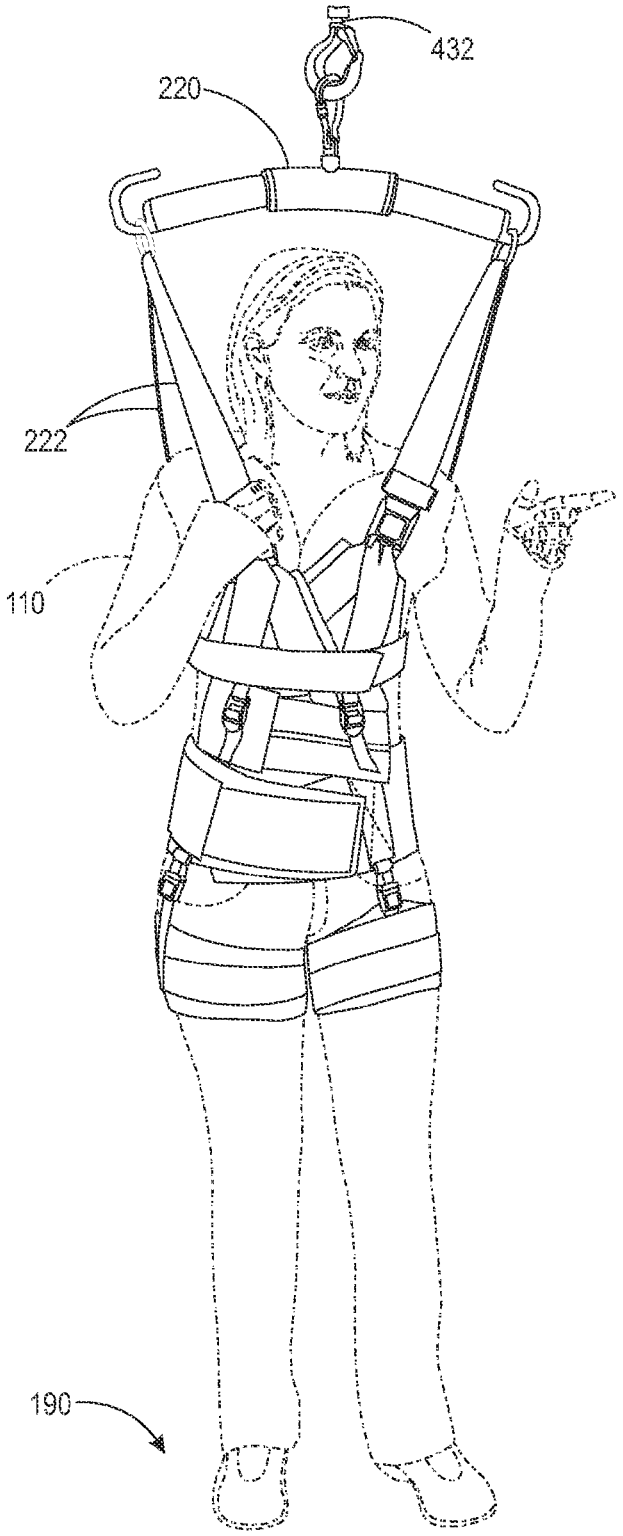
FIG. 2 is an illustration of a support harness assembly with a person in the harness.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Figure 17:
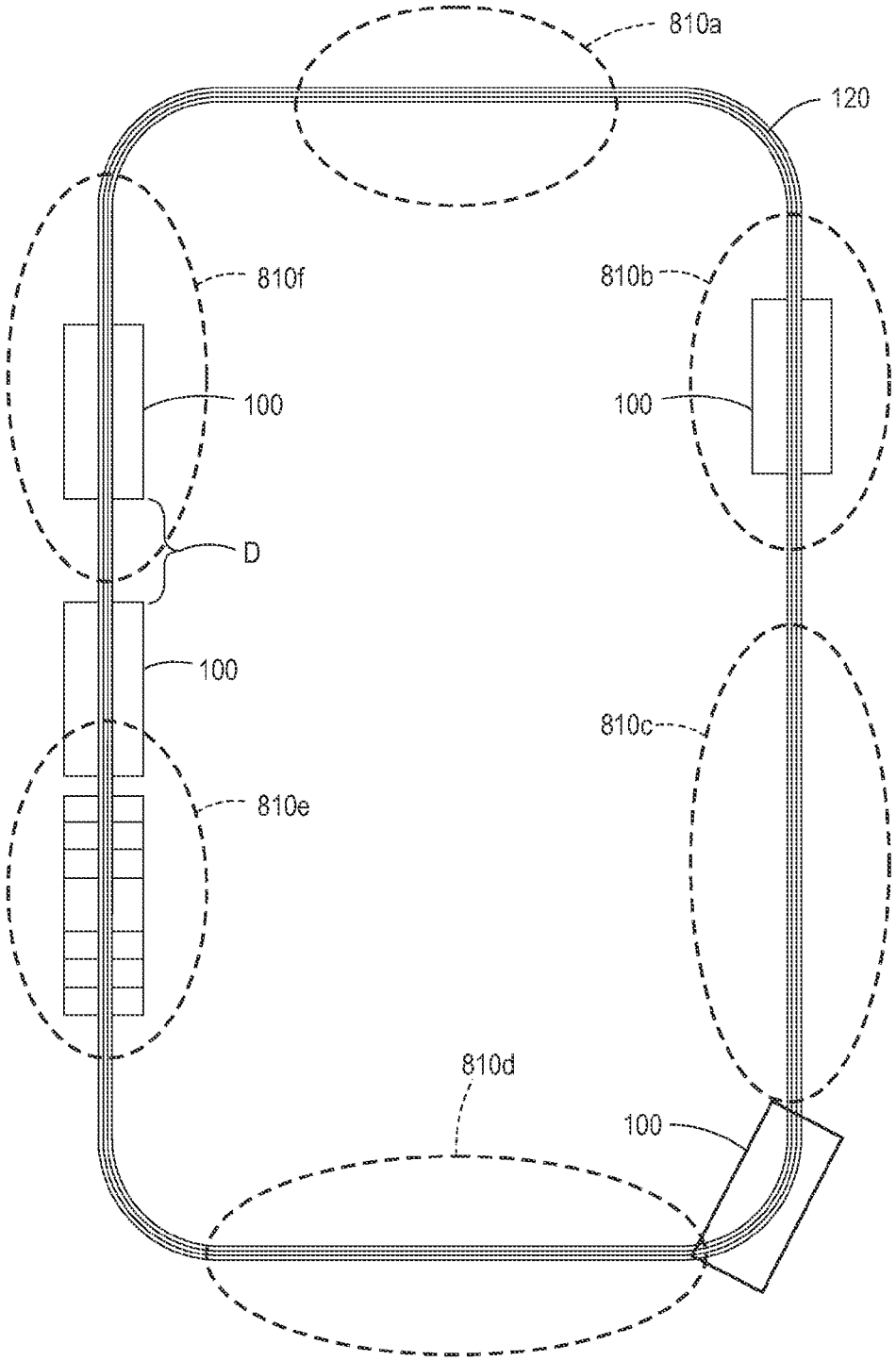
FIGS. 17 and 18 are exemplary illustrations of a generally rectangular track system.
Figure 18:
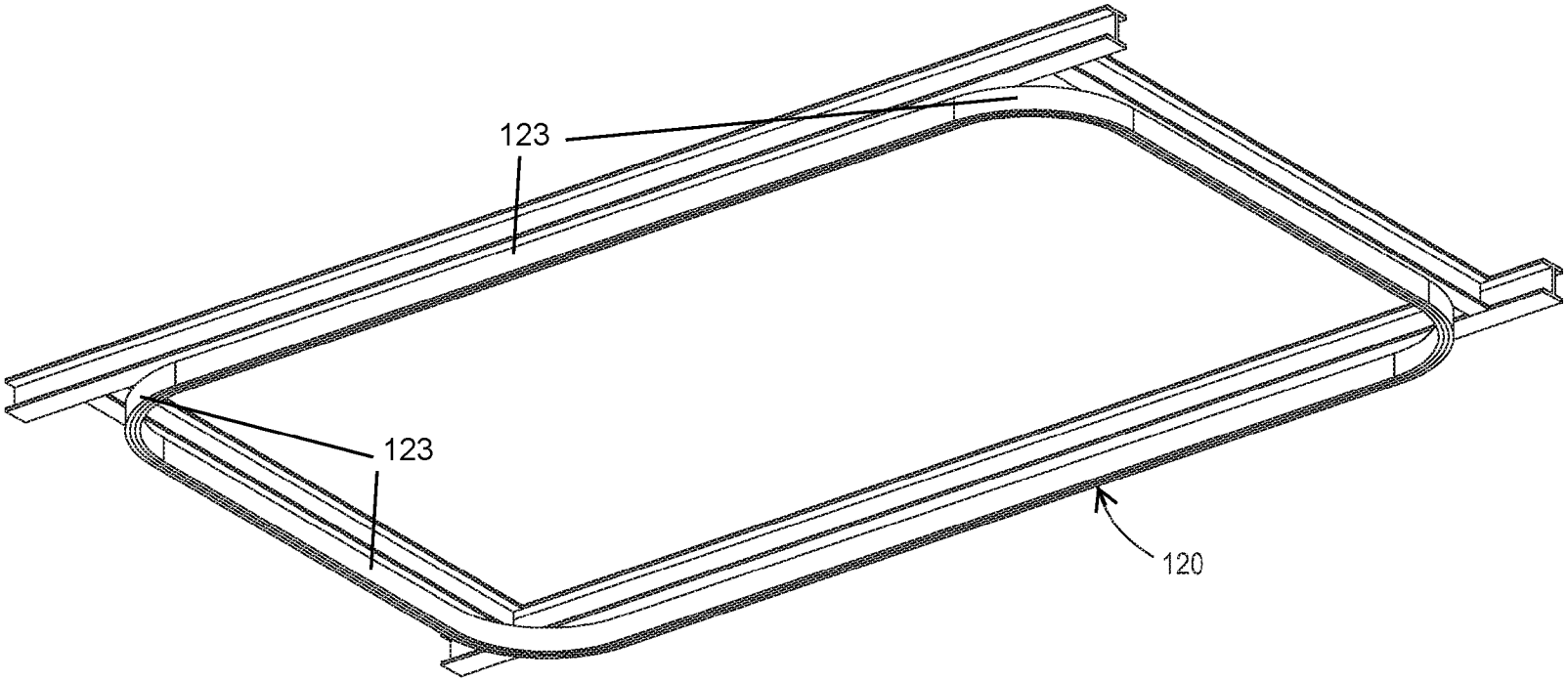

Referring to FIG. 1, depicted therein is a system 100 for supporting the weight of a person or patient 110. In a general sense, the system comprises a track 120. Although the following disclosure is largely directed to a track-type system, for example a looped track path as illustrated in FIGS. 17-18 (e.g., no-beginning or end), various aspects and features of the disclosed system and associated methods are contemplated as being supported by an arm (e.g., Jib crane, Gorbel EasyArm™), a cantilevered track section, and perhaps even a gantry with the ability to programmatically define a path over which the gantry trolley can move. In such alternative embodiments, a movable support unit or truck 104 includes a movable support or base 130, where the support 130 may be fixed to another movable member or may itself be movable relative to a supporting structure. The movable support unit further includes other components such as a horizontal drive 140, actuator 400, etc. as will be further described below (e.g., FIGS. 11, 14).

The movable support 130 is, in the embodiment of FIG. 1, operatively attached to the track 120, the support being movable along a path defined by the track. Moreover, the generally horizontal movement (H) of the support relative to the track or path along a longitudinal or central axis of the track or track section, and may be in both a first direction and in a second direction generally opposite to the first direction. While illustrated as a horizontal track over which the support 130 travels, also contemplated is a track system where one or more portions or sections of track 120 may be raised or lowered relative to the remainder of the track and/or where a surface or flooring 190 beneath the track is raised or lowered at varying positions, so as to provide or simulate typical scenarios where the person is proceeding up or down an incline, stairs, curbs, etc.

Continuing with FIG. 1, a first or horizontal drive 140 is attached to the movable support, and the first drive includes, in one embodiment, a pinion 124 configured to interact with the toothed indexing portion or rack and in response to the rotational motion of the drive 140, the support is moved along the path defined by the track. As will be appreciated, the horizontal drive is thereby operatively coupled to the indexed portion on the track to reliably control the horizontal position of the support along the track. Using an appropriate drive, for example a servo drive motor provided by B&R (Model #8LS35), it is possible to be relatively precise in both controlling and monitoring the position of the drive and support. More specifically, due to the relationship of the pins or lugs 126 on the pinion 124, and the direct coupling of such pins to the "teeth" on the rack 122, any angular rotation of the pinion under the control of the motor will advance or retract the position of the support along the track.

In contrast, in the alternative embodiment depicted in FIGS. 4-10, the horizontal drive 140 may be frictionally engaged with a surface (e.g., interior wall) of track 120. By driving along an interior wall, the system reduces the likelihood of debris interfering with the frictional drive. As will be appreciated, the operation of the horizontal drive 140 is controlled by a AC servo drive 144, or similar device that is both under programmatic control and further receives signals controlling its operation, for example via a horizontal force sensing assembly 150 and/or via a programmable device such as an industrial PC 170 including a user interface 172 such as that depicted by reference numeral 170 in FIG. 1. Power is supplied to the servo drive 144 via power supply 146.

Although depicted as a floor-mounted device, industrial PC 170 may take one or more forms and may be portable, floor-mounted, and may also include remote-control devices. For example, controller 170 may be a programmable logic controller, available from B&R (Model #PP500). In one embodiment, while there may be a main or centralized control point, that control point may consist of or include a wireless transceiver to communicate with one or more hand-held devices (smart phones, tablets, or customizable controllers) that are able to remotely control the operation of the system. Controller 170 may further include memory or storage devices suitable for recording information relating to system usage, patient information, etc. Wireless communications techniques may employ one or more radio frequencies (e.g., Bluetooth), as well as other bandwidth spectrums such as infrared. In one embodiment, the disclosed system may employ an Ethernet or similar communication protocol and technology to implement communications between the various system components. In this manner, a therapist or person attending the patient 110 may be able to control the operation of the device, select, set or modify a program for the patient, etc. as further represented in FIGS. 22-26. In other words, the therapist may be able to modify or change parameters associated with a patient on the fly using a kiosk, handheld tablet, etc. It is also contemplated that the communications may be of a wired nature between a controller 170 and AC servo drive 144.

Although described above in several figures as a rack and pinion type of indexing mechanism, it will also be appreciated that alternative methods and devices may be employed for reliably controlling the horizontal position of the support 130 relative to the track, including the friction drive mentioned and further described below with respect to FIGS. 4-10.

In one embodiment, an optical receiver/transmitter pair and sensor may be employed to track the position of the support, where a sensor detects an encoded position along the track. As will be described in more detail below, the ability to reliably control the position of the support enables the system to assure that position relative to stations or regions of the track/path (e.g., FIG. 17) are accurately determined, and to permit the potential for use of multiple units on a single track—thereby permitting a plurality of patients to use the same track simultaneously where the units can communicate with one another or with a central position control in order to assure that an appropriate spacing is maintained between adjacent units at all times. In an alternative embodiment, the individual support units themselves may include sensors or other control logic that prevents the units from coming into contact with one another while in operation.

It will be appreciated that although the horizontal position of support 130 is under the control of the horizontal drive, and the support itself otherwise freely slides or rolls along the path defined by the track 120. The support is connected to roller assembly 128 located on the interior of the track which provides rolling contact with at least the bottom interior of the C-shaped track, and the sides as well. Moreover, the interior of the track may be any conventional track, including a single piece of track or a collection of multiple pieces (e.g., oriented end-to-end). The track may also have electromechanical contacts therein (not shown) that are available to provide electrical power and/or signals to the drives and/or control mechanisms associated with the support. In other words, the roller assembly provides a means for operatively attaching the support to the track, yet minimizing friction using the associated roller assemblies.

Figure 5:
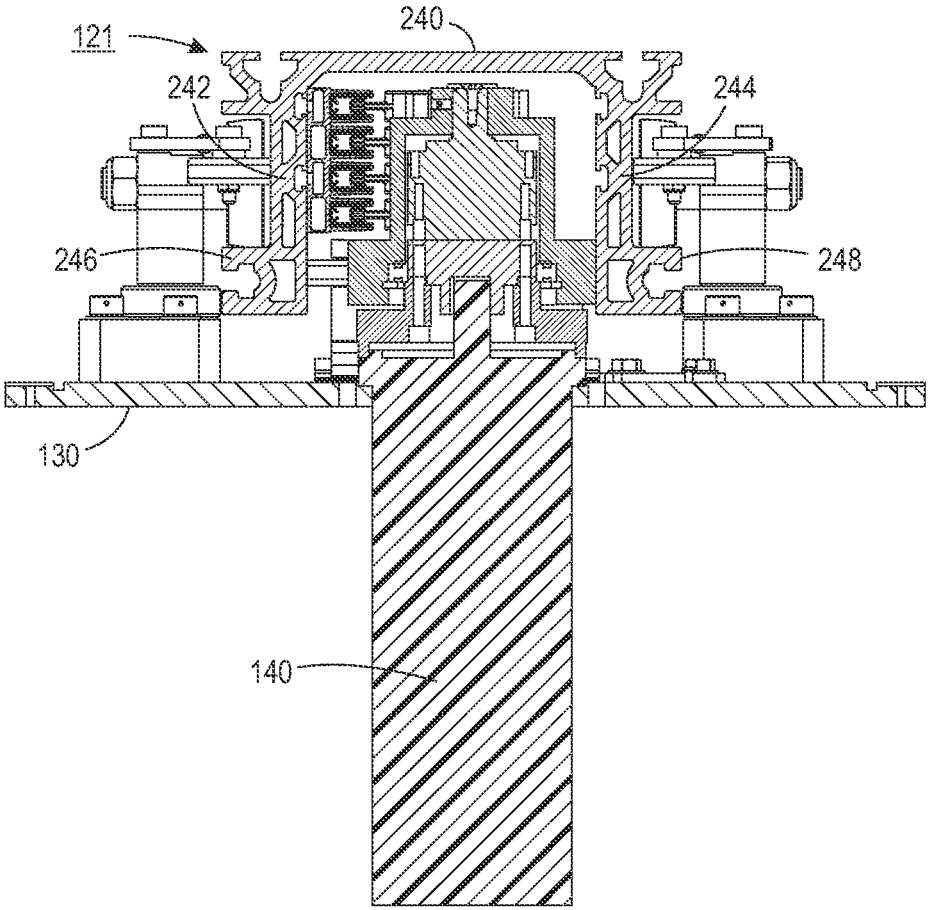
FIG. 5 is a cutaway end view along section 5-5 of FIG. 4.
Figure 6:
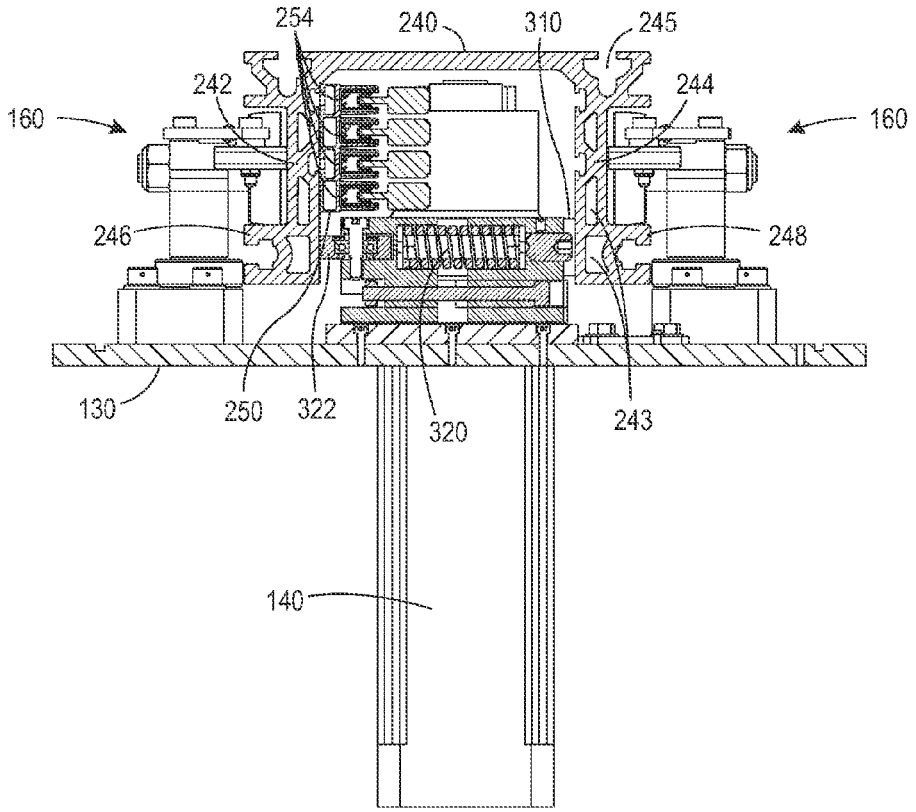
FIG. 6 is a cutaway end view along section 6-6 of FIG. 4.
Figure 7:
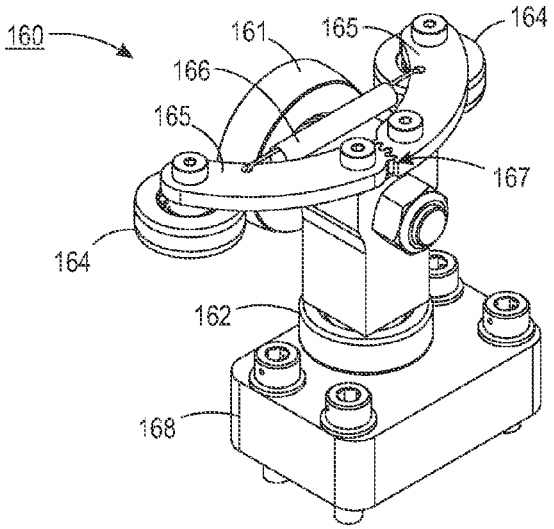
FIG. 7 is a perspective view of one of the support suspension assemblies of the embodiment of FIG. 4.
Figure 8:
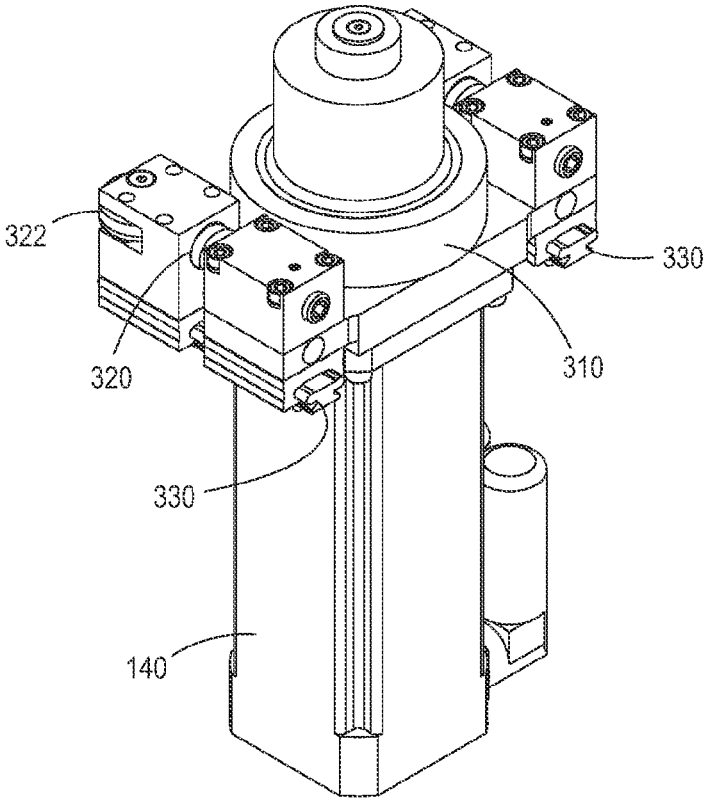
FIGS. 8 and 9 are, respectively, perspective and top views of the frictional horizontal drive of the embodiment of FIG. 4.
Figure 9:
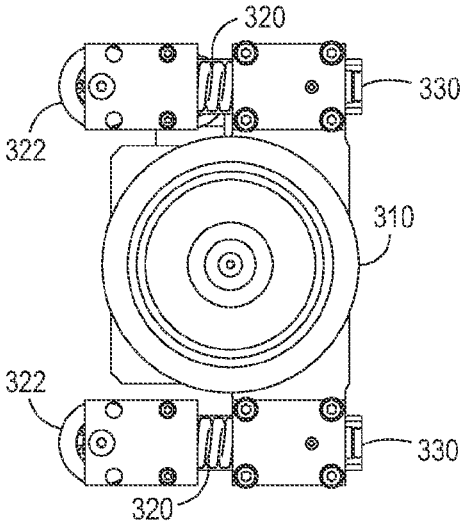

In an alternative configuration such as that depicted in FIGS. 4 - 10, the components of the system are modified to provide a track where support is provided on the exterior of the track and the drive and power interfaces are located on the interior surfaces of the track. As illustrated, for example in FIGS. 4 - 6, the alternative track 121 comprises an assembly of a plurality of extruded members 123 joined end-to-end (see e.g., FIG. 18). The track cross-section is illustrated in FIGS. 5 and 6 which show, respectively, sectional views 5-5 and 6-6 of FIG. 4.

The track includes a generally planar upper web or surface 240, extending in a longitudinal direction. From the upper web 240, opposing sides 242 and 244 extend in a downward directed along each side of the upper web.

The combination the upper surface and downward-extending sides form the interior portion of the track 121. Each of said opposing sides further includes a shoulder 246, 248, respectively, extending in an outward direction therefrom, where the shoulders are oriented perpendicular to the respective side. As further illustrated in the cross-sections, the track includes one or more enclosed channels 243 extending the entire length of each of the downward-extending sides, where the channels reduce the weight and increase the rigidity of the track section. The track sections may further include at least one T-slot 245 suitable for the insertion of a mounting component (e.g., screw or bolt head) therein to facilitate installation and suspension of the track from a ceiling or similar structure. Although not depicted, the track sections are designed to be connected end-to-end using studs or similar splicing members (e.g., a cam-lock splice) that span from the end of one member to the adjoining end of the next track member.

Figure 10:
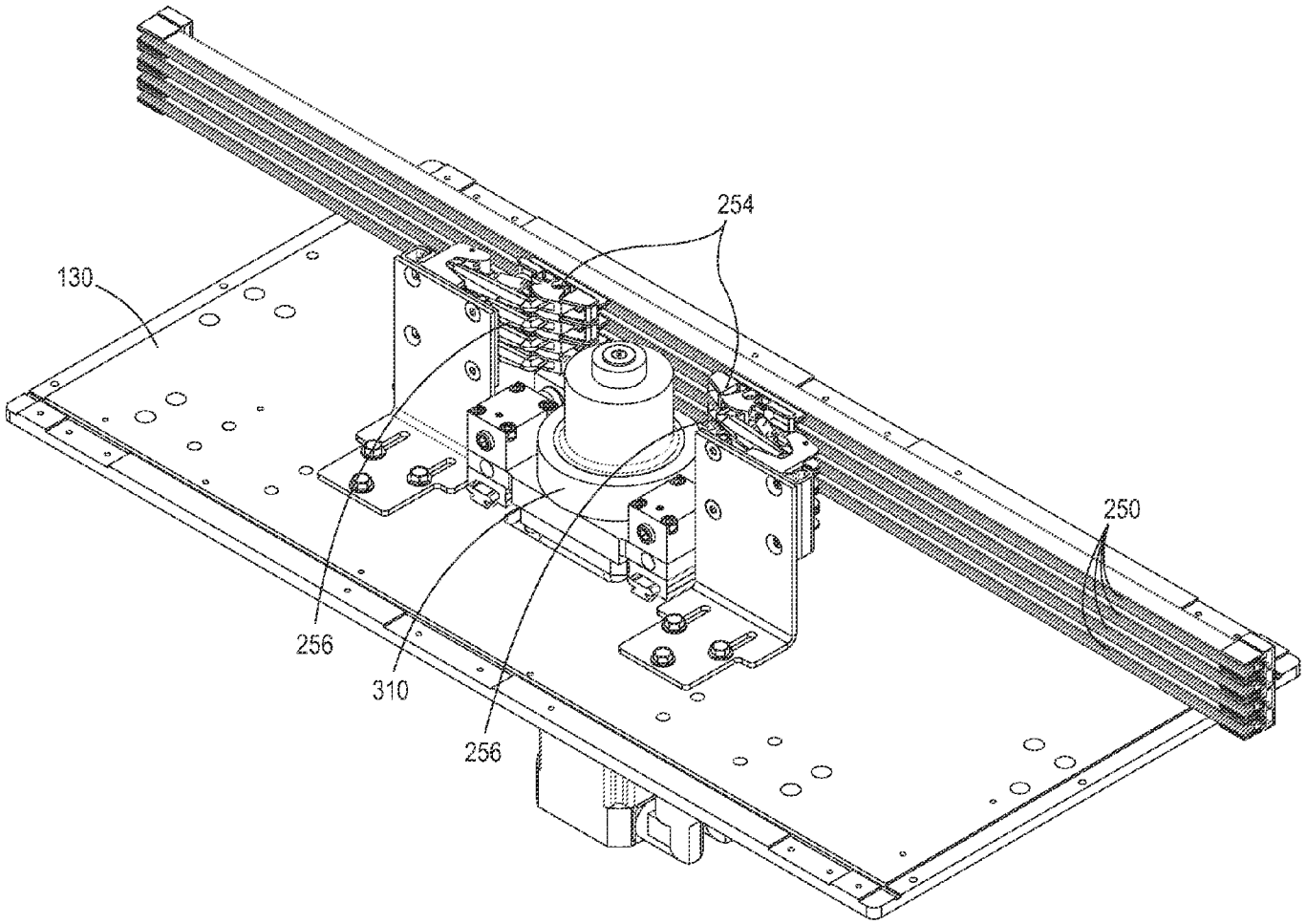
FIG. 10 is a perspective view of the embodiment of FIG. 4, including components on the interior of the track.

Multiple electric or power rails 250 are spaced along an interior portion of the track along one of the interior sidewalls for each portion of track over which the movable support unit travels. The rails are mounted to the track using insulated standoffs that are attached via internal T-slots provided in the interior of the track sides. Power is transferred from the rails to the control system and motors via one or more shoes 254 that are slidably engaged with the rails, and associated cabling, to ensure power is available. As illustrated in FIG. 10, for example, two shoe assemblies 256 and associated support structures are employed in the system in order to assure continuity of power as the movable support unit 104 travels along the track.

Referring also to FIGS. 6 and 8-10, the alternative frictional drive system will be described in further detail. Under the operative control of motor 140, the frictional drive employs a wheel 310 that is maintained in contact with an inner surface of the track, on the side opposite that which contains the power rails. In other words, the drive wheel 310 is biased away from the power rail side and into contact with the opposite side of the track. The biasing force applied to wheel 310 is supplied via springs 320 and idler wheels 322, where the idler wheels ride against the interior side of the track and force the drive wheel 310 into frictional contact with the opposite side. The drive assembly (FIG. 8) is allowed to slide or "float" relative to the support 130 as it is operatively coupled to the support 130 via slides 330. As a result of the disclosed alternative frictional drive mechanism, the first or horizontal drive 140 is slidably connected to the movable support, and the frictional drive mechanism is able to move relative to the support 130, along a direction that is generally perpendicular to the longitudinal axis of the track.

Figure 12:
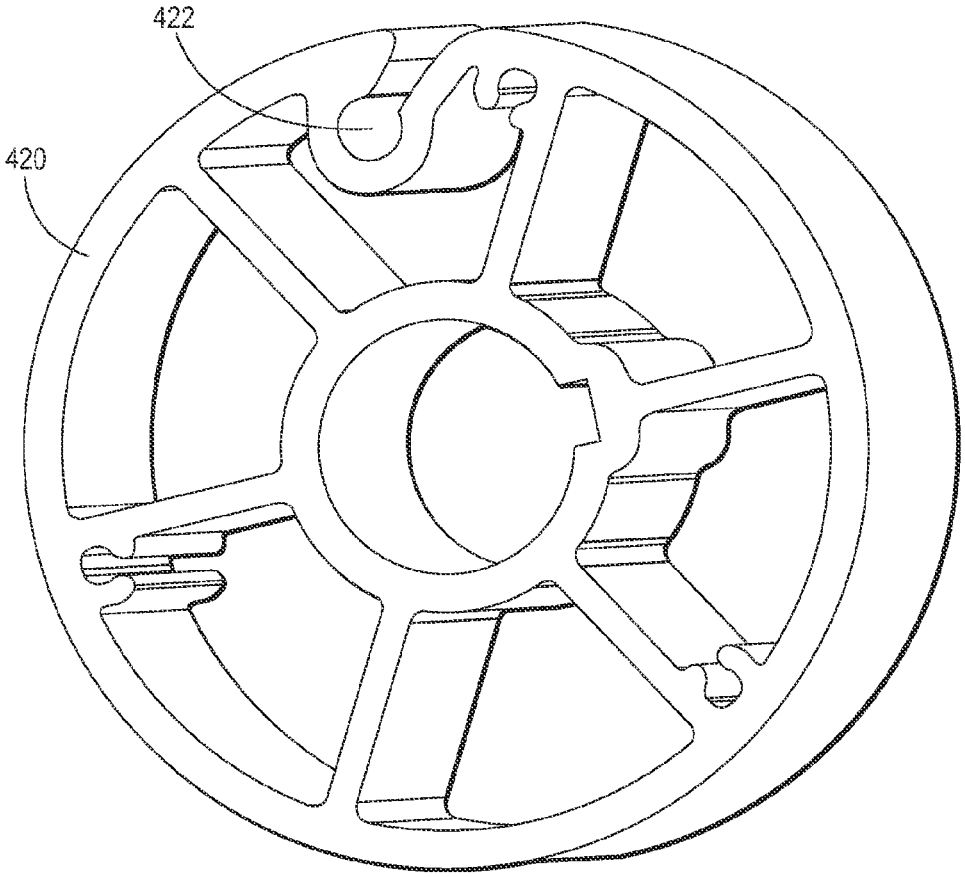
FIG. 12 is a perspective view of the drum used to wind the strap in the system of FIG. 11.

Planar support 130 is intended to be self-centering. That is to say that support 130 is maintained in a horizontal position that is generally centered relative to the track by the combination of at least four suspension assemblies 160 that are depicted in detail in FIG. 7. Each of the assemblies includes a top shoulder wheel 161 and a side shoulder wheel 162, where the top and side shoulder wheels each maintain contact with respective surfaces of the shoulder (246 or 248) extending outward from the track sides. In order to assure that the side shoulder and top shoulder wheels maintain contact and to assure proper tracking of the support, each suspension assembly further includes track idler wheels 164, along with cammed idler arms 165, that are pivotally attached to the assembly and operatively connected to one another via a toothed cam 167. Moreover, arms 165 are biased toward the track side surface that they contact by a spring 166. In this way the suspension assembly applies an equalizing force to the mounting block 168, which is in turn affixed to the support plate 130 to cause the plate to self-center during travel and while at rest. Having described the equipment and methodology for driving and controlling the support horizontally, attention is now turned to the balance of the system 100. Referring also to FIGS.—3, 11 and 14, the system further includes an actuator 400 attached to the movable support, where the actuator includes a second drive 410 and associated transmission 412, such as a worm-gear transmission, connected to and driving a rotatable drum 420. One advantage of employing a work gear transmission is the speed reduction of the worm gear is resistant to movement and acts as a braking mechanism should the braking feature of the vertical drive motor 144 fail. The drum 420, is depicted in perspective view in FIG. 12. The second or belt drive 410 is an ACOPOS servo drive produced by B&R in Austria (Model #1045) The drum has a strap 430, having a first end attached in a receptacle 422 and wound about an outer surface of the drum, with a second end of the strap ending in a coupler 432 to connect to a spreader bar 220 and support harness 222 (or similar supportive/assistive device) attached to support a person 110. The strap 430, and as a result the attached spreader bar and/or harness, is raised and lowered under the control of the belt drive 410. In one embodiment a harness having features such as that disclosed in U.S. Pat. Nos. 4,981,307 and 5,893,367 (both patents hereby incorporated by reference) may be employed with the disclosed system.

Although an exemplary strap and harness are depicted, it should be appreciated that various alternative harness configurations and support devices may be employed in accordance with the system, and that the intent is not to limit the scope of the disclosed system to the harness depicted. Similarly, the strap 430, although depicted as a flexible, braided member, may be any elongate member suitable for suspending a person from the system, including rope, cable, etc. having braided, woven, or twisted construction, or possibly even linked or chain-type members. In one embodiment the strap is made from a sublimated polyester, and is intended to provide long life and resistance to stretching. As some therapeutic harnesses are presently adapted for use with strap-type support members, the following disclosure is generally directed to a strap-type member being wound around drum 420.

Figure 11:
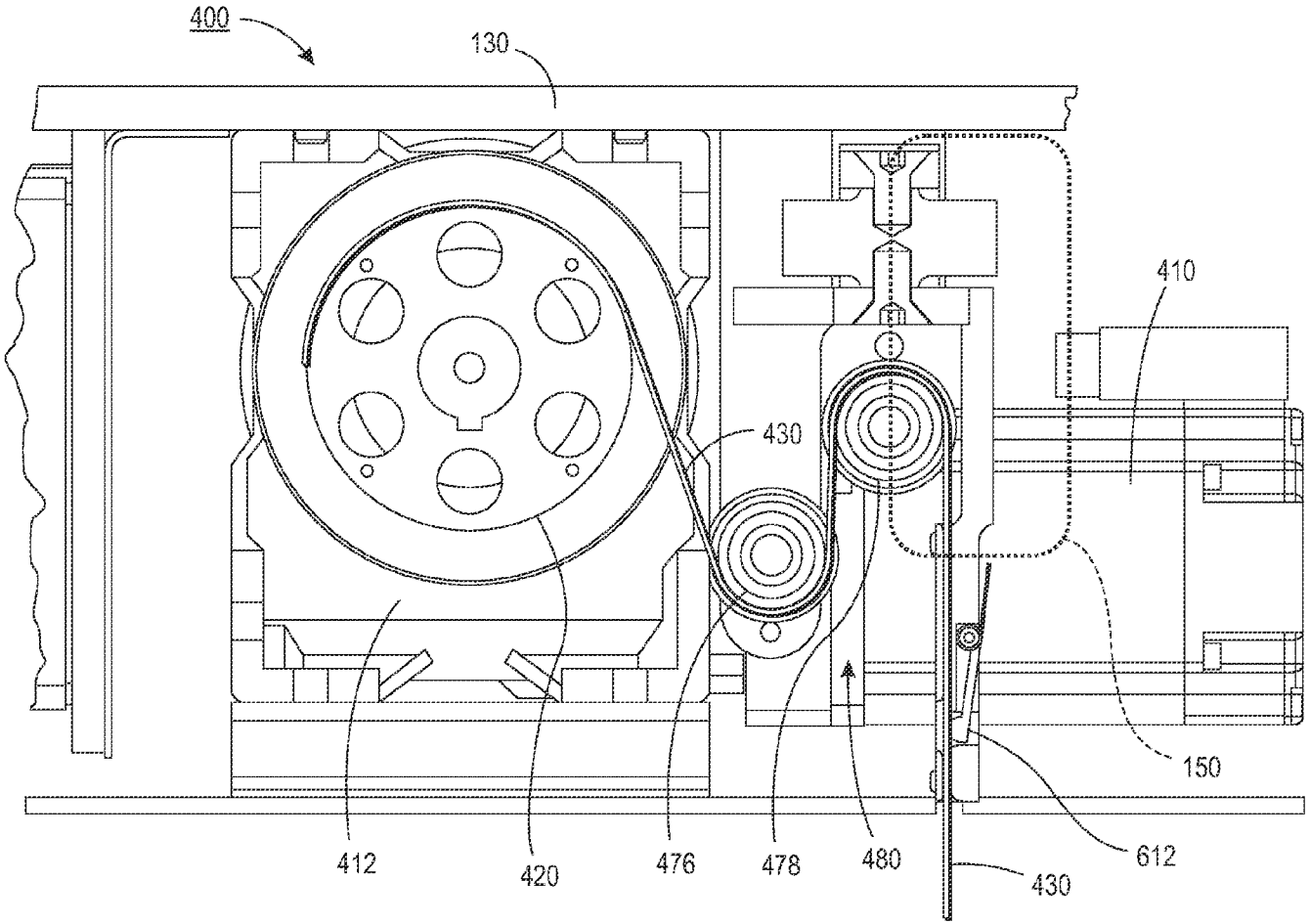
FIG. 11 is an enlarged view of a portion of the support including components of the vertical lifting system.
Figure 13:
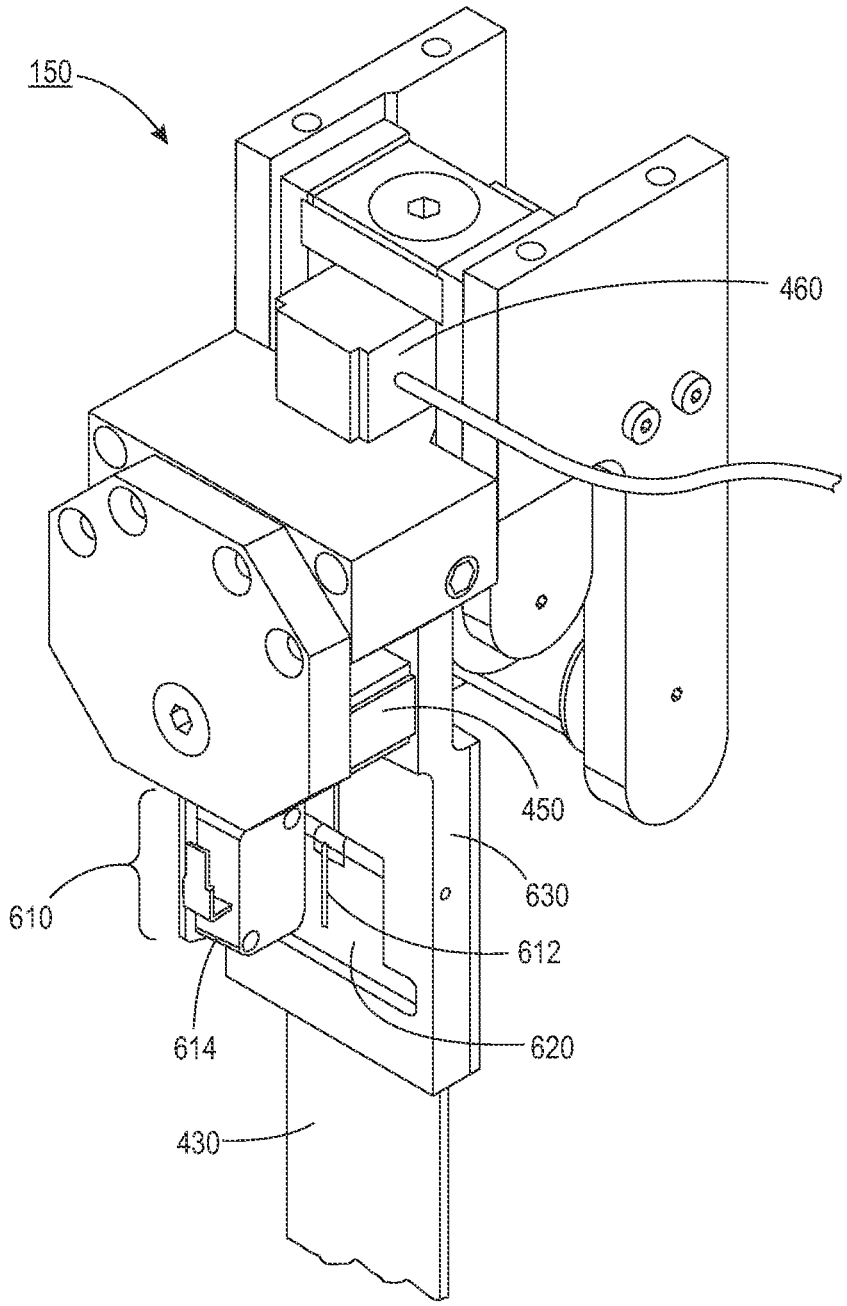
FIG. 13 is a perspective view of a strap slack/tension sensing system.

In one embodiment, as depicted in FIGS. 11 and 13 for example, the system includes a first or horizontal load sensor 450 for detecting a horizontal force applied to the support via the strap and a second or vertical load sensor 460 for sensing a vertical force applied to the strap. The load cell for the horizontal sensor 450 may be a bi-directional, in-line sensor suitable for axial force measurement.

Sensor 450 senses relative position change by a deflection in the downward-extending strap guide. More specifically, as the strap is moved forward or backward in the horizontal direction (H), sensor 450 generates a signal that provides a magnitude of the force applied in the horizontal direction, as well as the direction (e.g., +/−), and outputs the signal to the controller via cable 452. Thus, the horizontal force detection system detects a horizontal force via the strap using the strap guide operatively attached to and extending from the movable support unit, where the strap guide is operatively connected to a load cell in a manner that results in a change in the load cell output when the strap is pulled in a direction forward from or backward from vertical.

Figure 14:
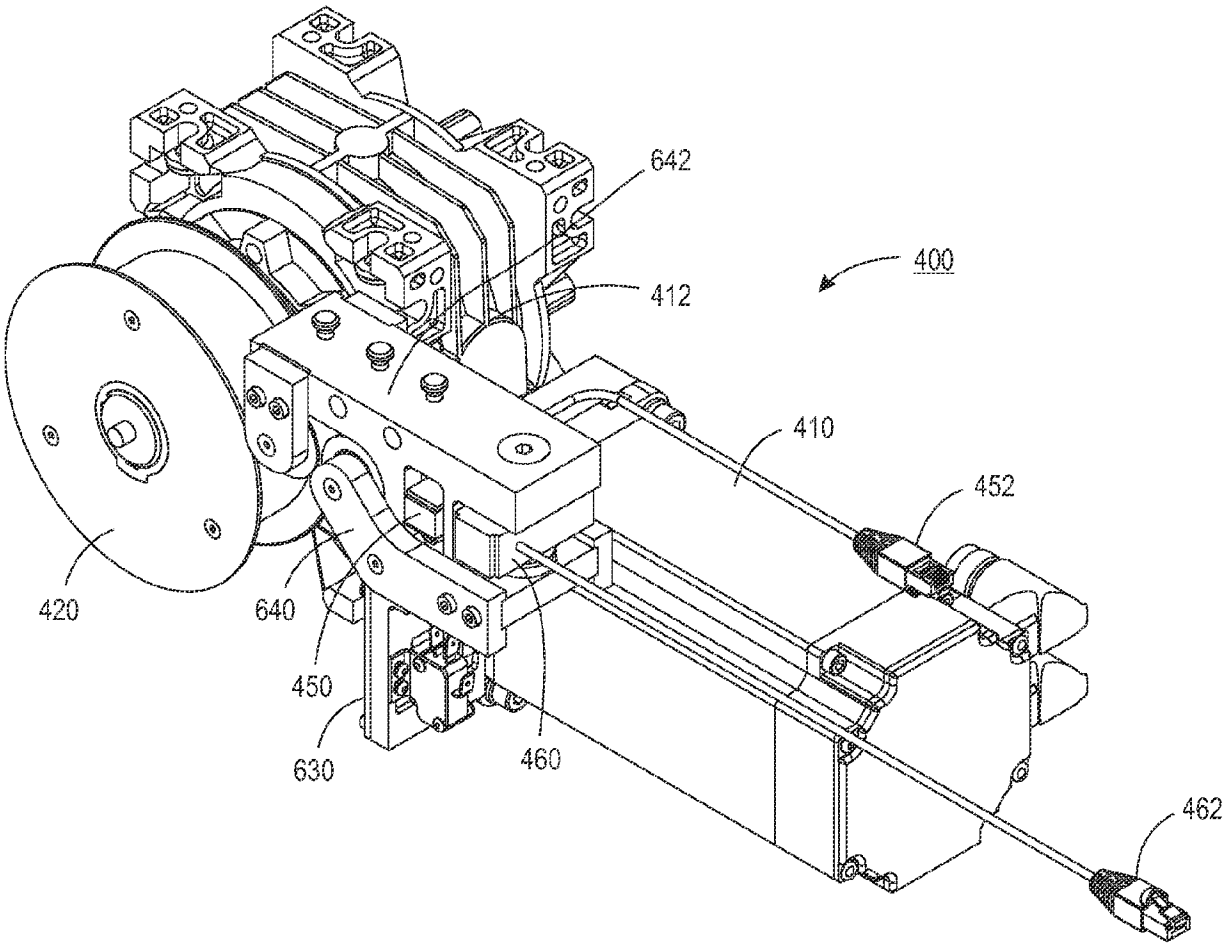
FIG. 14 is perspective view of a vertical drive, drum and strap sensing system in accordance with the support embodiment of FIG. 4.
Figure 15:
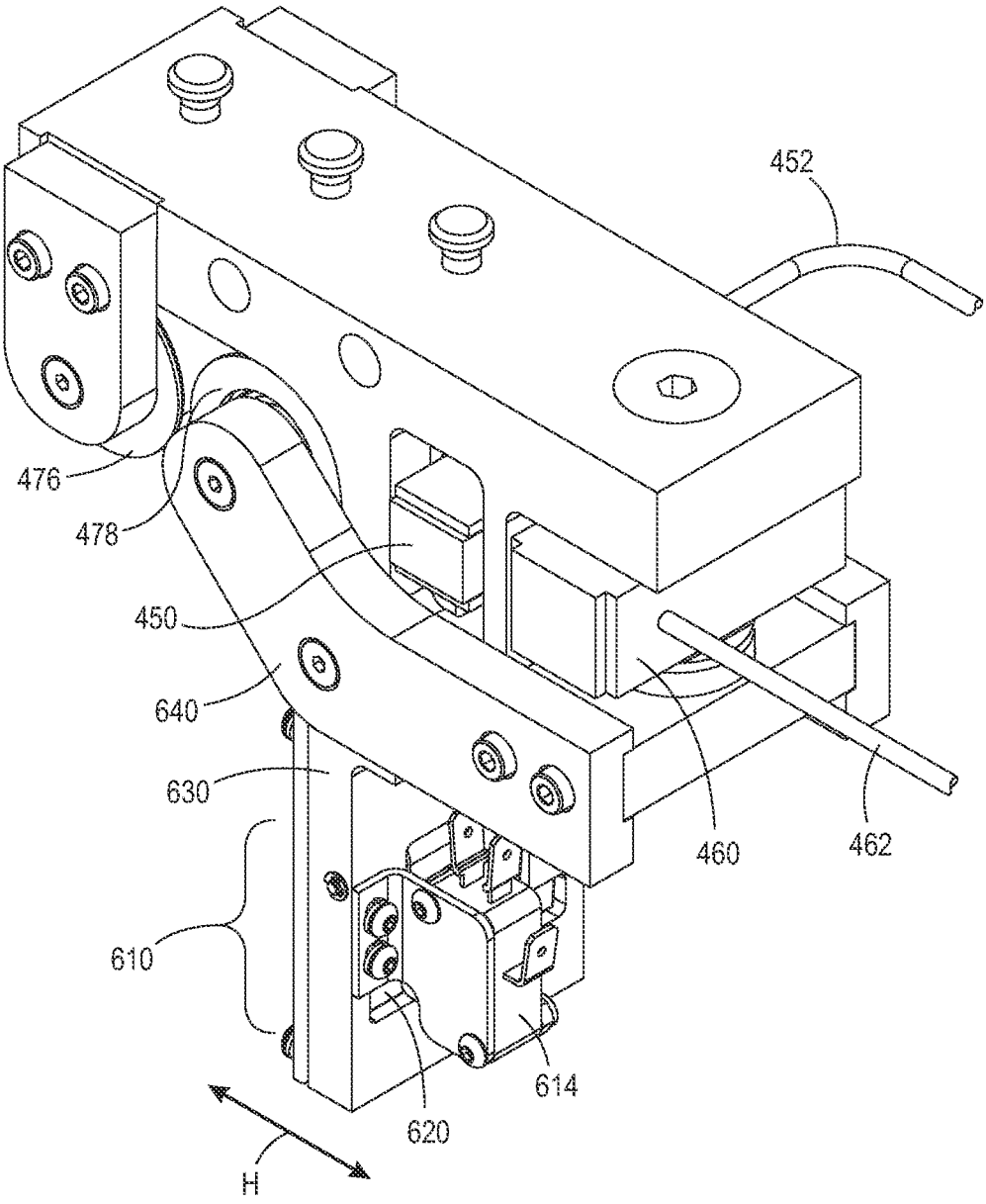
FIG. 15 is an enlarged view of the strap slack and tension sensing system in accordance with the embodiment of FIG. 4.

The strap or vertical force sensor 460, in order to provide increased resolution, is employed in a compression-only configuration, to sense the force or tension in strap 430. In the system load sensor is used for sensing a downward vertical force (tensile force) applied to the strap, and the sensor assembly includes at least two pulleys or rollers 476 and 478 in a single or double-reeved pulley system 480. The pulleys are located between the drum and strap guide 630. As illustrated in FIGS. 14 and 15, for example, the pulley is connected on one end of a pivoting arm 640; there the arm is pivotally attached near its midsection to a frame member 642 coupled to the movable support plate 130. The opposite end of pivoting arm 640 is operatively associated with a load cell 460, so that a downward force applied via strap 430, results in a similar downward force being applied to pulley or roller 478. In turn, the downward force is transferred via arm 640 to apply a compression force on the load cell 460. Thus, load cell 460 is placed only in compression in response to a load suspended on the strap.

In response to signals generated by the load sensors 450 and 460, a control system, configured to receive signals from the first and second sensors and the user interface 172, controls the movement of at least the first and second drives to facilitate the support and movement of the person 110. Moreover, in accordance with one aspect of the disclosed system, the control system dynamically adjusts to provide constant support to the person via the strap and harness by altering at least the vertical force applied to the strap via the drum and second drive 410.

With respect to the vertical force, the controller operates, under programmable control to process signals from the vertical load sensor 460 via cable 462, in combination with prior inputs or pre-set information that sets vertical assistance to be applied to the person via the vertical drive and strap components. For example, the system may have various exercise or therapy modes, whereby the amount of vertical lift supplied is adjusted or modified based upon the particular exercise being conducted. For example, walking over a flat surface the system may control the vertical force to allow the patient to experience about a 90% body weight, whereas on an incline or steps the percentage may be slightly lower, say at about a 70% body weight. To accomplish the control, the system must first determine the patient's body weight—either by sensing it directly in a full support mode or by having the weight (e.g., patient body weight plus spreader bar and harness) entered via the user interface. Once determined, the vertical load sensor (load cell) 460 is then employed in a "float" mode to apply an adjusted force of say 10% (100−90) body weight to the strap and harness, and thereby reduce force experienced by the patient to approximately 90% of the patient's body weight.

Figure 16:
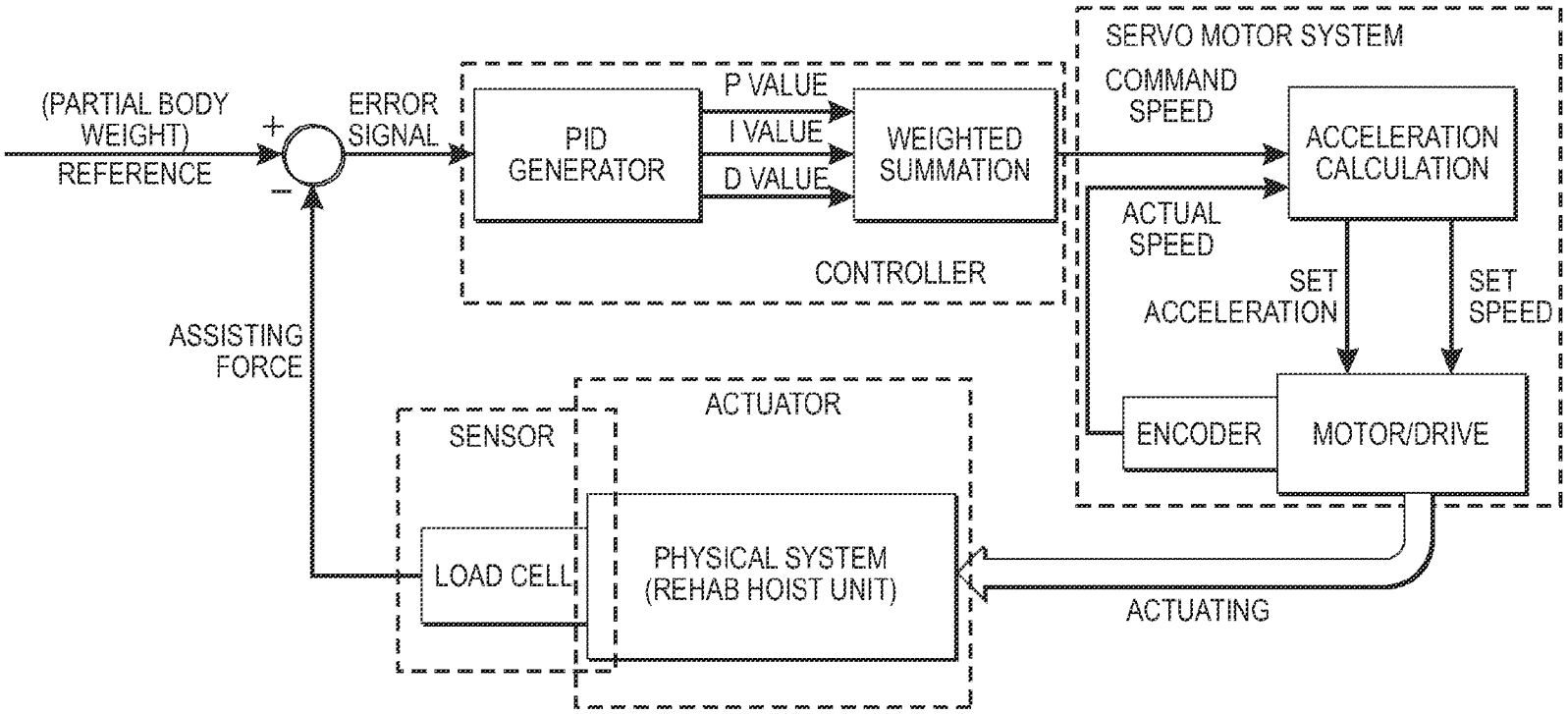
FIG. 16 is an illustration of the control flow for a disclosed embodiment of the rehab support system.

Referring briefly to FIG. 16, depicted therein is a control diagram indicating the relative relationship amongst system components, including the controller, drive servo motor system and the sensor feedback loop The closed-loop control system is applied in both directions (horizontal and vertical) using a PID control technique; proportional (P), integral (I) and derivative (D) gains. Moreover, an acceleration calculation routine is run prior to engaging a motor so that the motion profile for the system drives are smooth.

In a manner similar to that of the vertical force sensor, horizontal load sensor 450 similarly senses the horizontal component of the load applied by the user via the strap 430. In this way, when the patient is engaging in an exercise that is intended to move along the track or path, the system 100, or more particularly the support 130 and associated components may also index or move along the path in order to provide continued vertical support as the patient advances forward or rearward along the path defined by track 120, thereby minimizing the effect of the weight of the unit on the person. Another horizontal load sensing alternative contemplated is the use of a trolley suspension mechanism, with a moment arm associated with the suspended trolley having a load cell attached thereto, to sense changes in the force applied through the moment arm.

In one embodiment, the vertical and horizontal load and position control is accomplished using a programmable controller such as a ACOPOS servo drive, from B&R (e.g., Model #1045). Moreover, the functionality of the controller allows for the control of both the horizontal and vertical positions simultaneously so as to avoid any delay in the movement and to assure coordination of the control—particularly relative to limits, exercise modes, etc. as will be further described below.

Referring also to FIGS. 11-15, the belt or strap 430 is wound on a drum 420 in a yo-yo-like fashion, so that the drum contains a plurality of coiled layers of the strap, and is fed through a reeved pulley system 480 to enable the reliable control of the strap and to facilitate sensing forces exerted on the strap. In view of the strap being wound upon itself, the position sensing mechanism associated with the vertical drive operates under the control of an algorithm that automatically adjusts the motion control to account for the change in radius as the strap is rolled or coiled onto and off drum 420. Also illustrated in FIGS. 13 and 15 is a belt tension sensing system 610, where a spring-biased arm 612 or similar contactor is in contact with the strap within a window 620 in guide 630. The arm pivots relative to the guide whenever the strap is slack, and in response to pivoting, the position is sensed by micro-switch 614 and causes a change in the state of the switch. Thus, when the strap is slack (i.e., not taught), the arm pivots under the spring force and the micro-switch is triggered to cause the system to stop further movement in either the vertical or horizontal mode—other than manually controlled movement.

Having described the general operation of the vertical and horizontal load control system, it will be appreciated that this system may be employed to enable multiple exercise modes for the patient. For example, the user interface may be employed to select one or more of such exercise modes to be used. It may also be, as illustrated in FIGS. 17 and 18, that the exercise mode may be controlled via the location of the support relative to the track (e.g., 120). Referring to FIG. 17, for example, depicted therein is a track 120 that is laid out in a generally rectangular path or course. Along the path are a series of stations or zones 810*a*-810*f*, each of which may have one or more exercises to be completed at that station. For example, one station (810*a*) may be designed for walking on a flat surface and may have a set of parallel bars or railings for patient assistance. Another station (810*e*) may have an inclined ramp or stairs that the patient traverses, perhaps at a higher level of assistance (i.e., with a lower percentage of body weight being carried, thus a higher level of vertical force applied via the strap). As the support moves from one station to another around the loop as illustrated in FIGS. 17 and 18, the type and/or amount of assistance and the nature of the control may be pre-programmed according to the particular zone. It will be appreciated that the locations and characteristics of each zone may themselves be programmable via the user interface and that it is anticipated that loops or paths of varying size and configuration may be customized for the needs of particular patients, therapy centers, etc. For example, it may be possible to have a patient's programmatic information stored within a system, and when the patient arrives for therapy, the support system assigned to them is automatically programmed for the same or a slightly modified therapy session from the one that they experienced on their last visit.

As noted above, the use of multiple system units 100 is contemplated in one embodiment. However, it will also be appreciated that the use of multiple systems may require that such systems be able to avoid collisions. Thus, as illustrated in FIG. 17, the systems, either through a master controller suitable for monitoring the position of all systems, or through intercommunication between the systems themselves, maintain information related to the relative position of adjacent devices such that they maintain a safe separation distance D between the units. Although not illustrated, in the event of a system employing multiple system units, it is further contemplated that one or more units may be "parked" on a spur or other non-use location when not in use in order to allow unimpeded use of the entire therapy circuit by only a single user.

Figure 19:
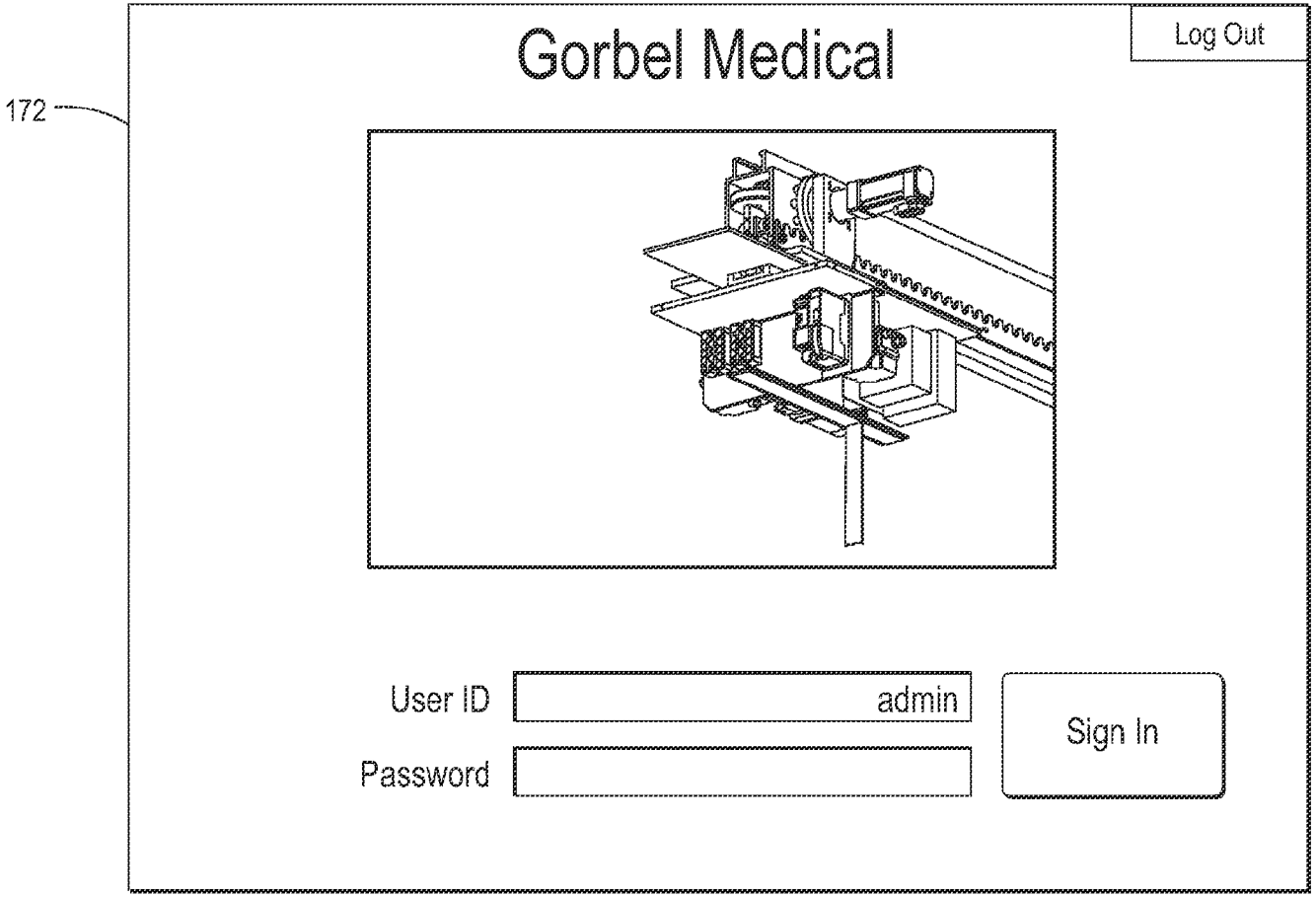
FIGS. 19-21 are illustrative examples of user interface screens for controlling basic operations of the rehab lift system.
Figure 20:
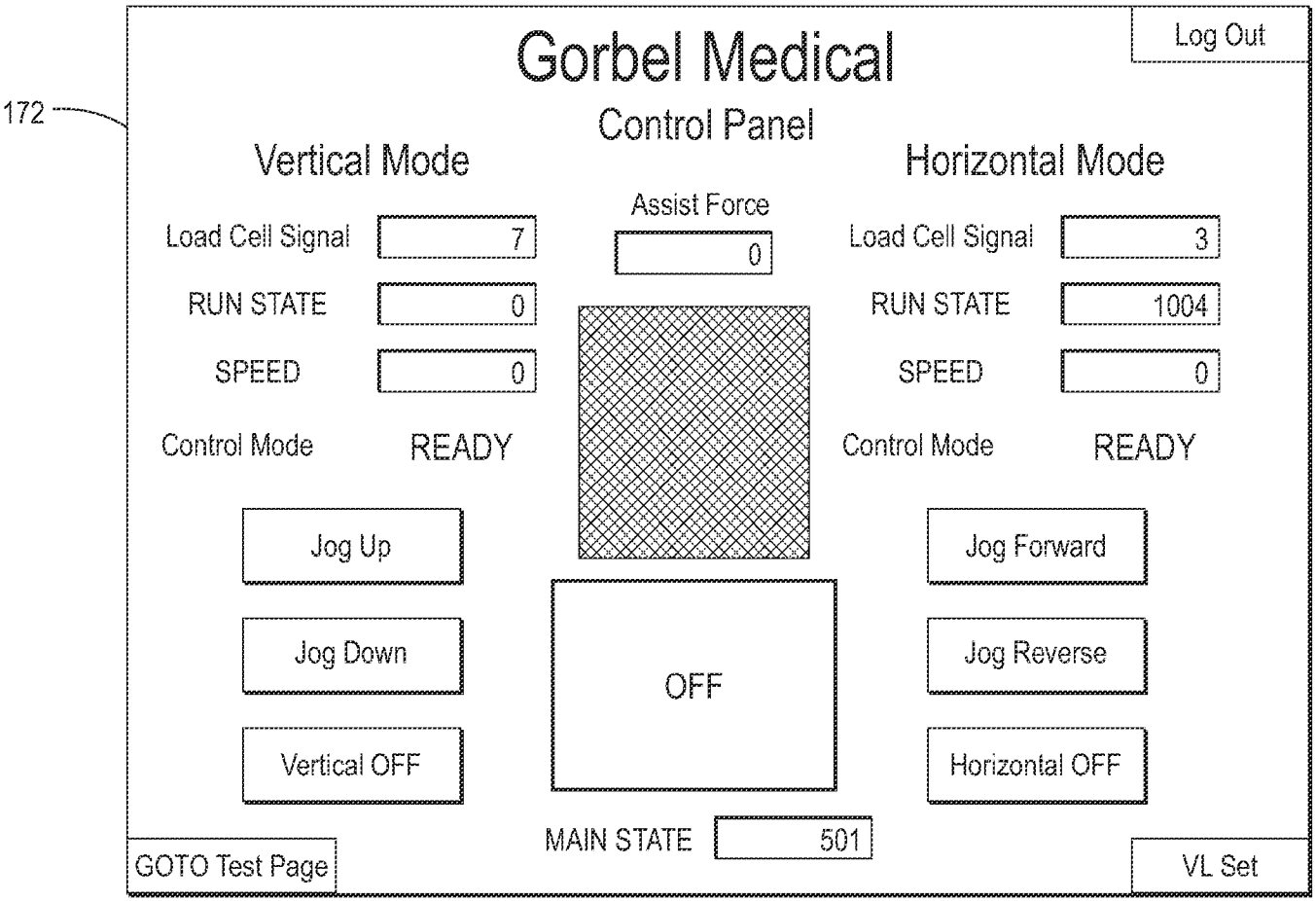
Figure 21:
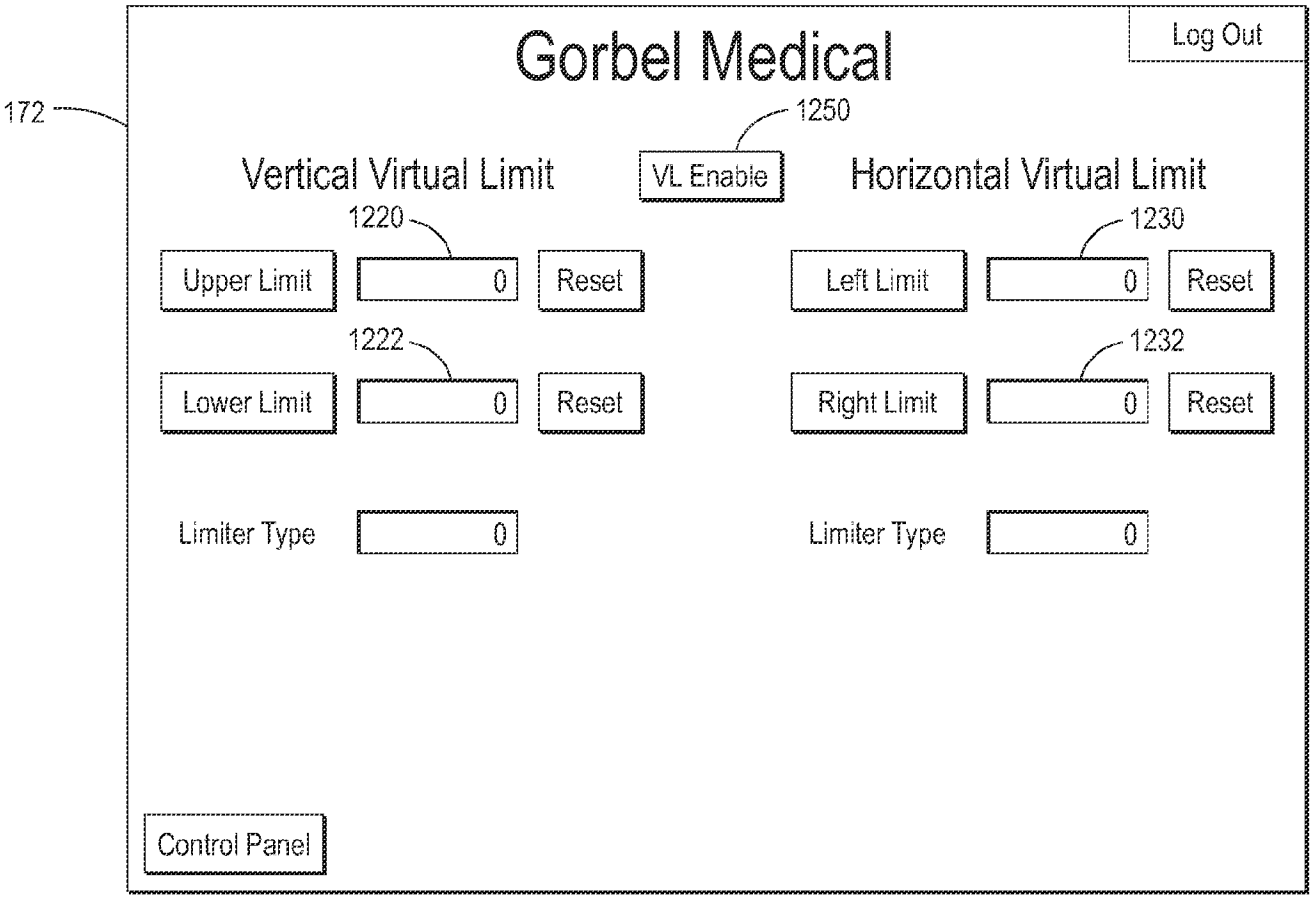

Referring to FIGS. 19-21, depicted therein are exemplary user-interface screens to demonstrate operational features of the disclosed system. The screen depicted on U/I 172 in FIG. 19 is a login screen to access the system control pages (interface), several examples of which are found in FIGS. 20-21. In FIG. 20, a control panel screen is illustrated for interface 172. The screen includes information for both the vertical and horizontal controls (modes), including fields indicating the respective load cell signals, run states and speeds. Also indicated is the control mode, in both cases showing READY, to indicate that the system is ready for use of both the vertical and horizontal controls.

In the lower part of the screen of FIG. 20, there are shown a series of buttons permitting the manual control of the vertical and horizontal drives, respectively. Each subsystem may be jogged in either direction and the controls for that subsystem may also be disabled. Various system states, including systematic and/or actuator related state numbers, can be displayed for maintenance and/or troubleshooting. Also, the on/off controls for both horizontal and vertical motion are located this page.

Also contemplated in accordance with the disclosed embodiments are one or more calibration techniques, whereby the various sensors (e.g., vertical load and horizontal force) are calibrated to assure accurate responsiveness to a patient. As noted herein, the load sensors are employed in different configurations and as a result the calibration techniques are also not the same. For example, the vertical force sensor is employed in a compression-only configuration and thus gives a 1:1 correspondence between the load applied and the output of the load cell. On the other hand, the horizontal load sensor is not a 1:1 relationship to the load. However, the horizontal load sensing is slightly less critical to the operation and support of a patient and therefore a lower resolution/responsiveness can be tolerated for the horizontal load sensor.

Another feature of the disclosed system is what is referred to as virtual limits. Referring also to FIG. 21, the user interface for the virtual limits is depicted. In one embodiment, there may be several types of limits that are set for a particular system or patient. The limit type may specify a "hard stop" limit, or a soft or transitional limit (where the operation of float mode is adjusted or disabled). For example, in the case of hard stop limits, the limits are set based upon the position—both vertical and/or horizontal. Referring to FIG. 21, the upper and lower limits are entered into fields 1220 and 1222, respectively. And, use of the reset buttons adjacent those fields allow the limits to be reset to a pre-determined or default level, or disabled. The left and right limits are similarly entered into fields 1230 and 1232, respectively, and they may also be reset to a pre-determined or default level or disabled. The interface is responsive to user input via one of many input methods (e.g., touch-screen, mouse, stylus, keyboard, etc.), and the numeric values entered into the limit fields may be done via a numeric keypad, scrollable window or other conventional user-interface means. Furthermore, such limits may be set by physically manipulating the unit into the position in which the limit is desired to be set, and then recording that location/position. It is further contemplated that the limits themselves may be set for particular zones 810, and that the values entered may be applicable over the entire system path or only over a portion thereof. It is also the case that the limits may be enabled or disabled via button 1250 on the screen of interface 172 as depicted in FIG. 21.

The user interface is also contemplated to facilitate the collection, storage and display of information related to particular patients, including not only settings for the therapeutic exercises as noted above, but additional information as well. For example, the interface may permit the collection and display of biometric information, user performance metrics, etc. The user interface may be enabled using various technologies in addition to or in place of the standing controller. Examples include wired and wireless devices or computing platforms as well as smartphones, tablets or other personal digital assistive devices, docking stations, etc. Moreover, the computing and/or control resources for the rehab lift system may reside in the controller 170, in the individual system units themselves, or in other locations that are easily accessed and interconnected through one or more wired or wireless connections.

Figure 3:
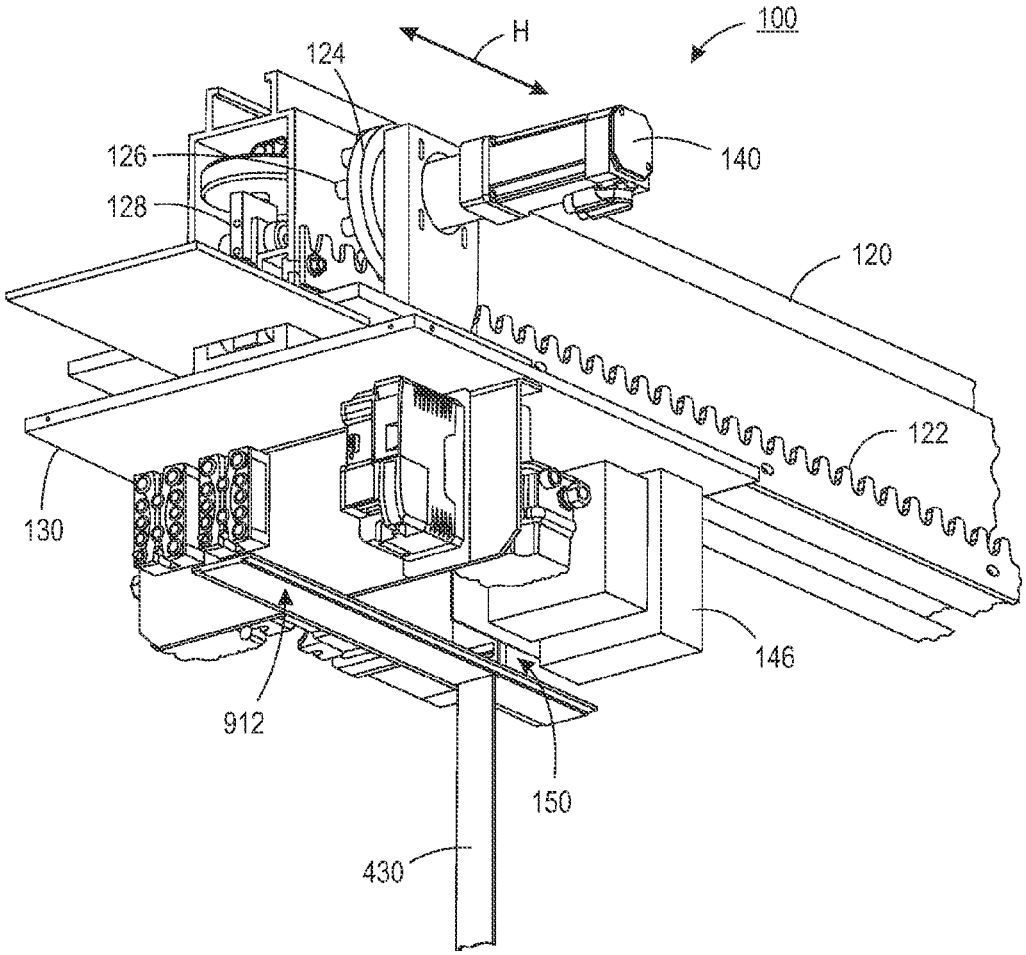
FIG. 3 is a view of a support on a section of track in accordance with a disclosed embodiment.
Figure 4:
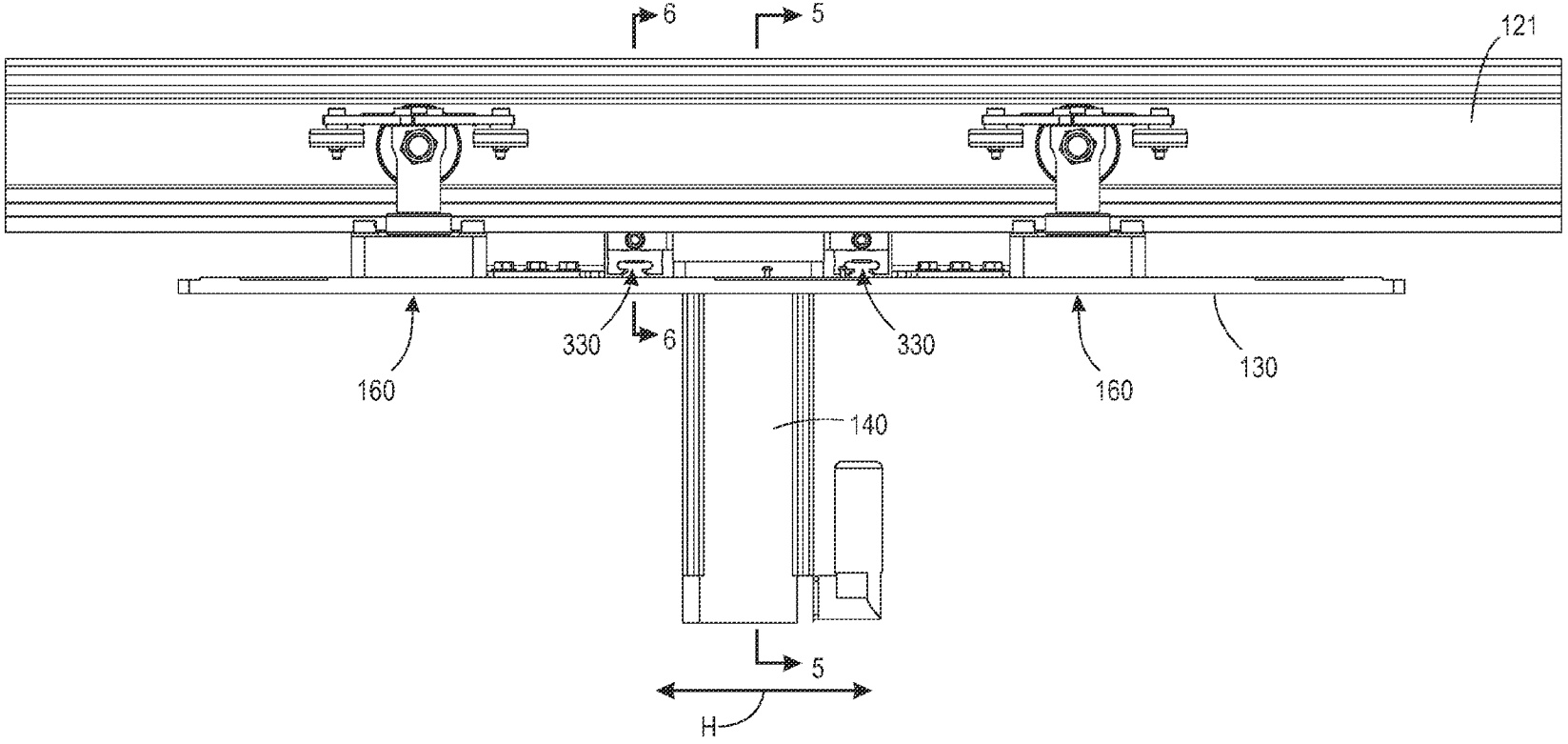
FIG. 4 is a side view of a support on a section of track in accordance with an alternative embodiment.
Figure 22:
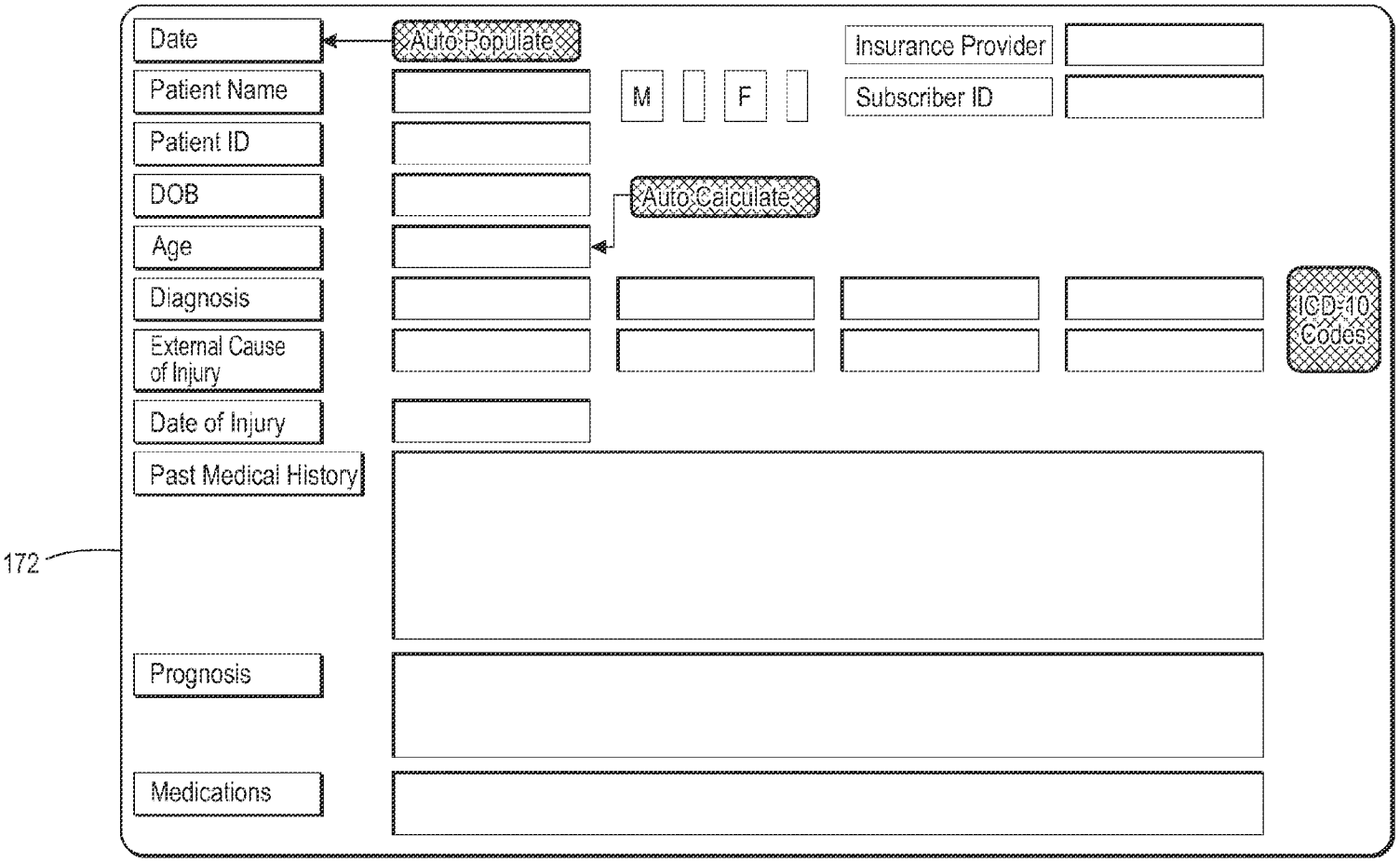
FIGS. 22-23 are illustrative examples of user interface windows for tracking and entering patient-specific information relating to use of a rehab lift system.
Figure 23:
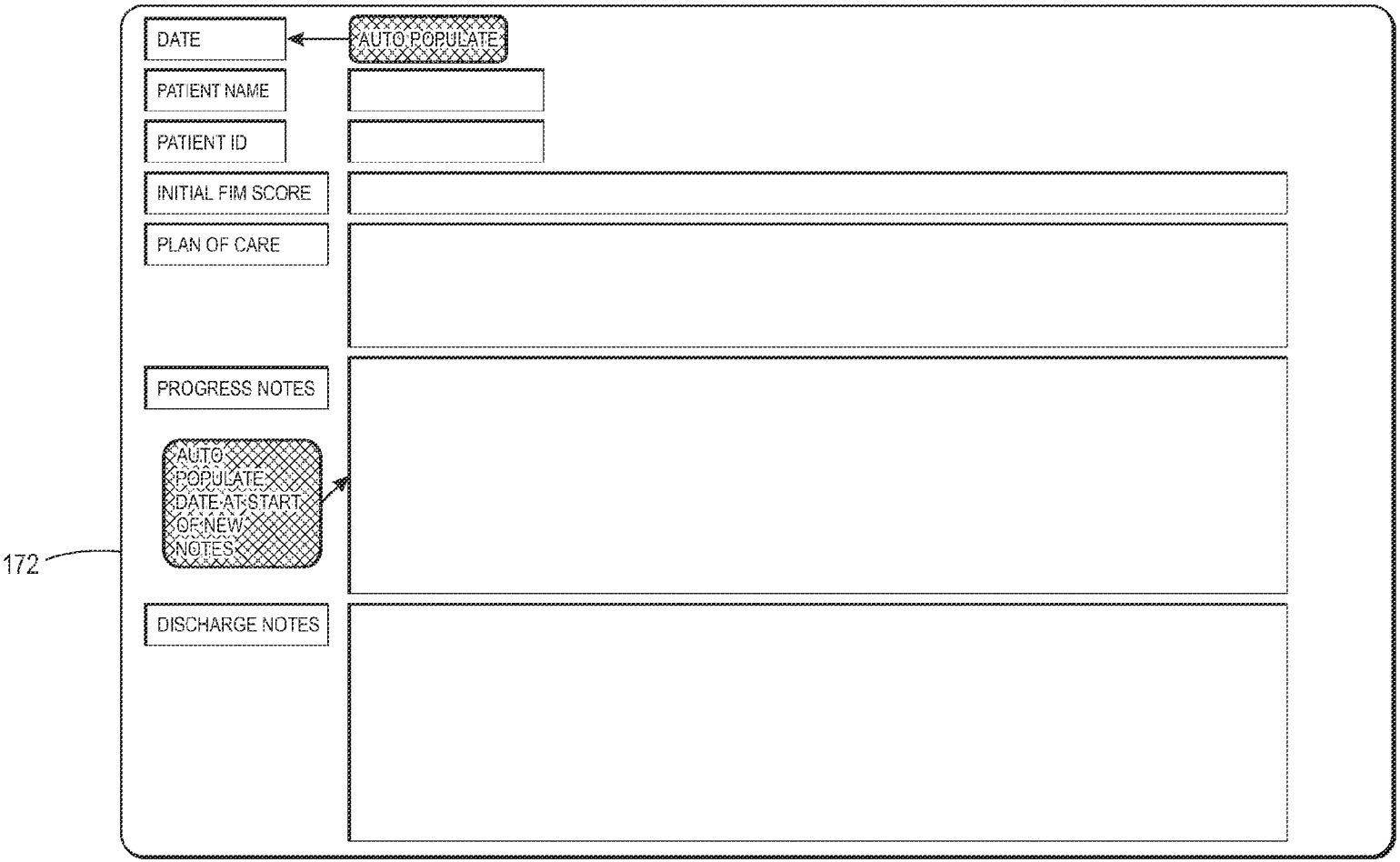

In one embodiment, in addition to a user interface, the system, particularly the movable support unit 104, may include one or a plurality of indicators such as light-emitting diodes (LEDs) that are under the control of and operated by the control system. The indicators may be provided on any external surface or housing of the support unit, and would be located in a position (e.g., FIG. 3, location 912) where they would be readily visible to a therapist and/or user of the system in order to provide a visual cue while the therapist is watching the patient using the system. The indicators would display an operational status of the system, and may further signal faults or other information based upon the LED color, mode (e.g., on, off, flashing speed) and combination with the other LEDs. As noted above, the user interface may include handheld as well as any permanently located devices such as touch screens and the like, may also be suitable for displaying information from the control system, and receiving information entered by a therapist to control an operation of the system (see e.g., FIGS. 19-21). As further illustrated by FIGS. 22-26, the system may include additional computing resources, such as memory or storage devices that enable the storage of data associated not only with system operation, but patient data as well. In one embodiment, the system includes an operation database for storing information relative to the operation of the system. Such a database may also store information relating to use of the system by different patients and their therapists. For example, FIGS. 22-23 are illustrative examples of user interface windows that may be used for tracking and entering patient-specific information relating to use of a rehab lift system. As shown in FIGS. 22 and 23, various fields are provided to both display and to enter patient information (or have it automatically populated from the database). Certain fields include patient record information for review by the therapist (e.g., date of injury, medical history, prognosis, medications in FIG. 22) while other fields allow the therapist to input information based upon the patient's use of the system (e.g., Initial FIM score, plan or care, progress notes, and discharge notes as illustrated in FIG. 23).

Figure 24:
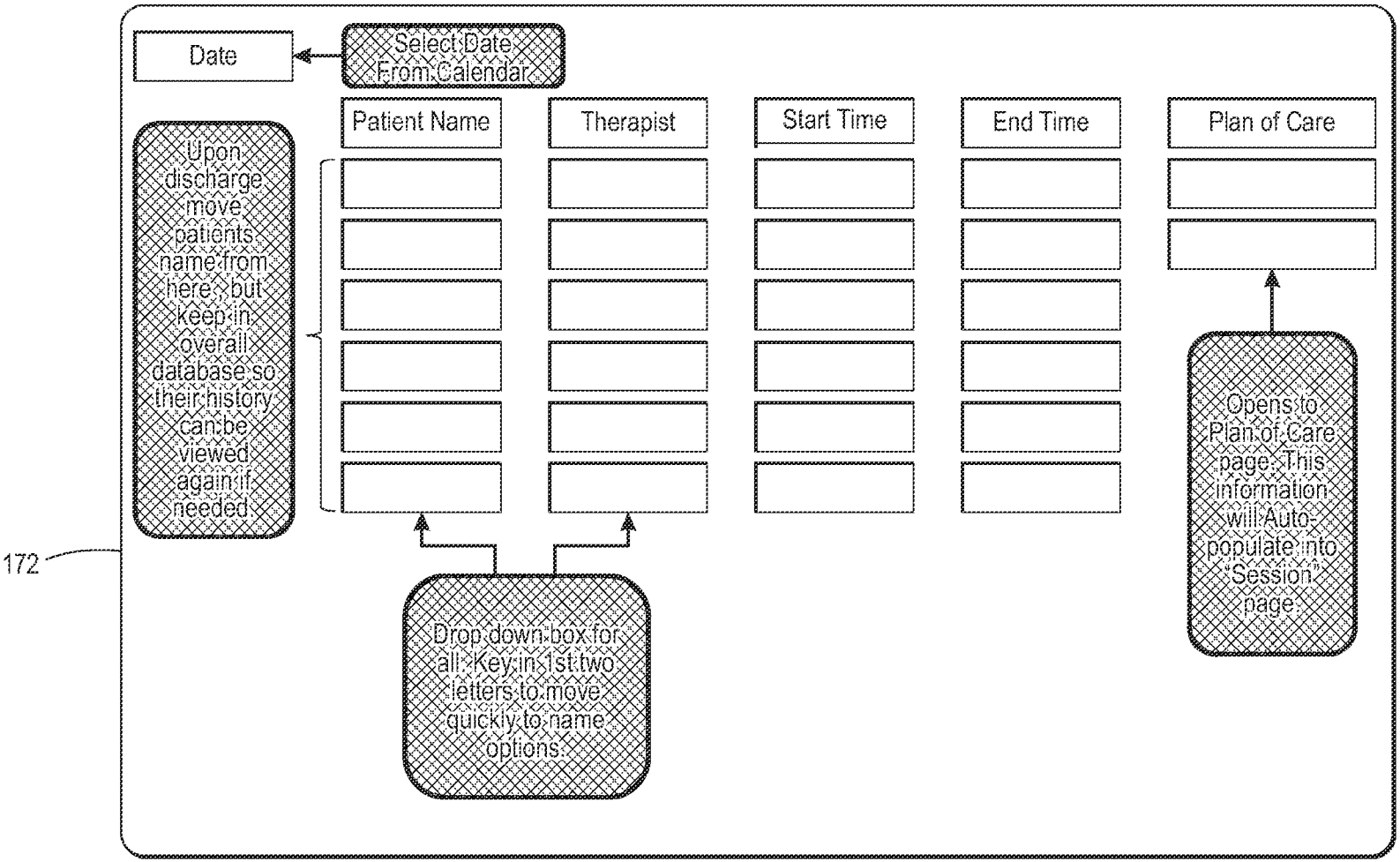
FIG. 24 is an illustrative example of a user interface day list window.
Figure 25:
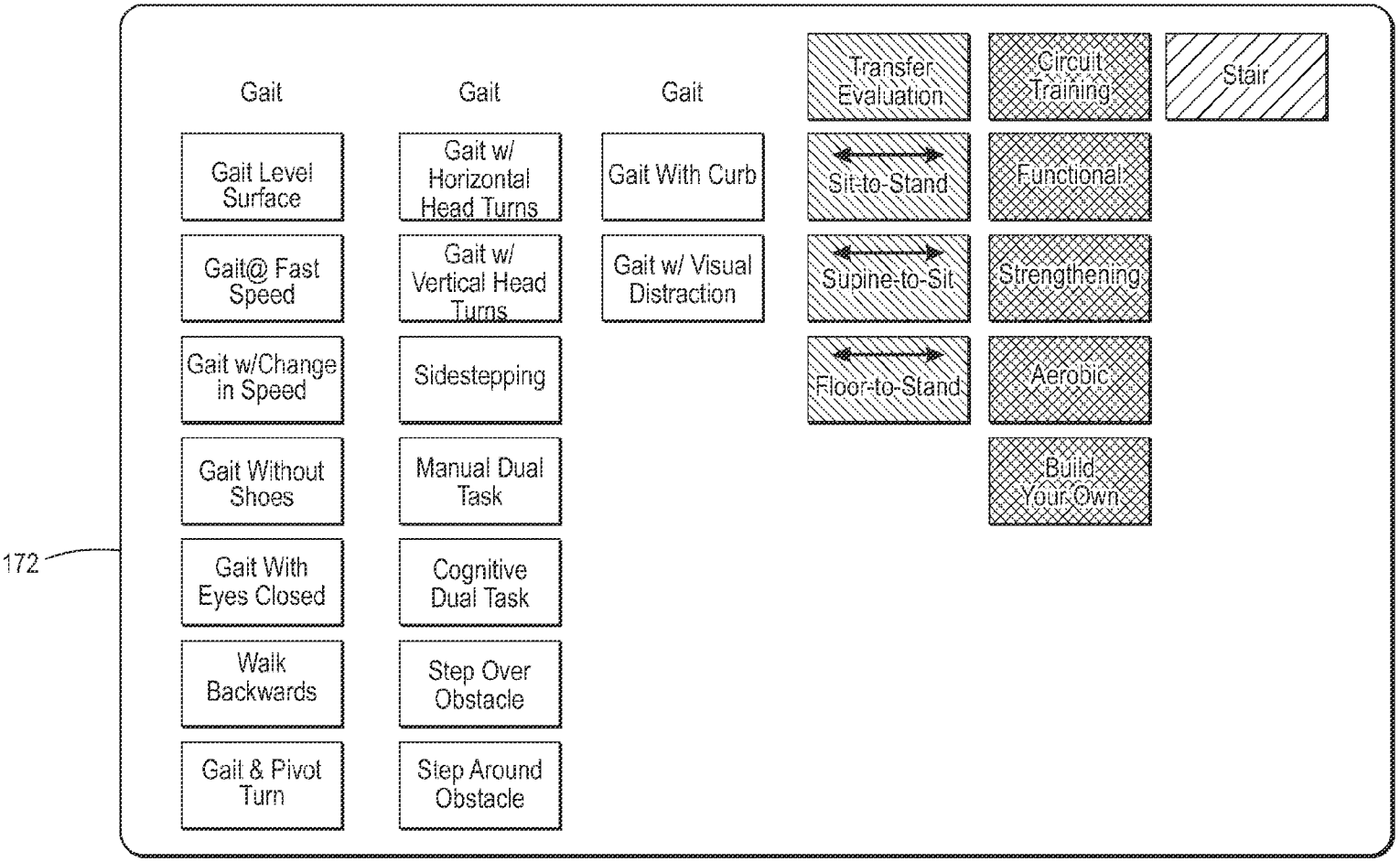
FIG. 25 is an illustrative example of a user interface plan of care window.
Figure 26:
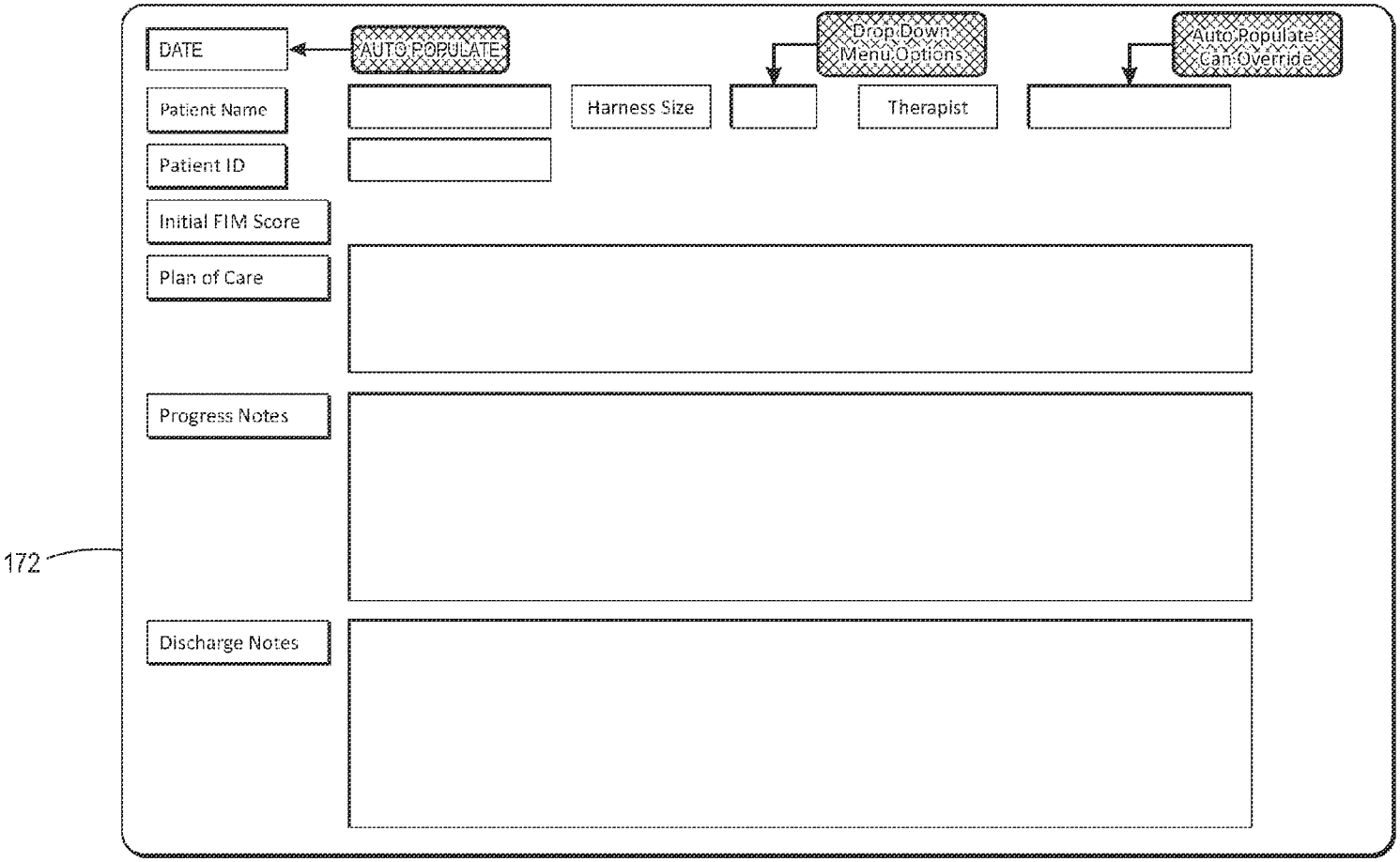
FIG. 26 is an illustrative example of a user interface window for review and entry of data for a patient session.

Referring briefly to FIG. 24, there is shown an illustrative example of a user interface 172 depicting a day list window that represents scheduling or usage of the system. As noted, some of the fields depicted on the interface window 172 of FIG. 24 may auto-populate from information contained in the system database, whereas other fields may be drop-down or similar data entry fields that are available to a therapist or other user of the system. Similarly, FIG. 25 provides an illustrative example of a user interface plan of care window on the user interface 172. In the plan of care window, a therapist may select from one or more pre-programmed activities for the patient. It will be appreciated that the various activities are subject to programmatic control and the input of certain patient-specific information that may be entered or previously stored in the database. Lastly, FIG. 26 provides an illustrative example of a user interface window for review and entry of data for a patient session. Once again, certain fields may be pre-populated with information based upon the patient ID or similar unique identifier. And, the patient session interface also includes fields for the therapist to enter information. It will be understood that the use and display of information is not limited to the particular interface screens depicted. Moreover, the system may also be able to track a patient's performance in order to measure the number of reps, amount of assistance, number of falls prevented, etc. in order to provide such data in the future, or as a performance measurement over time. The dynamic fall prevention aspects of the disclosed embodiments, particularly when the system controller is operated in what is referred to as a float mode, permits the sensing of dynamic fall events, and while preventing actual falls, the system can also log the occurrences for subsequent review and tracking.

Also contemplated is the automatic population of certain fields, as well as operational settings for the system, based upon not only the information stored in the database, but the entry of data by the therapist as well. As a result, a user interface available to a therapist or other user of the system may display information selected in the form of a patient record window, a day list window showing use of the system, a plan of care selection window and/or a session data window.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

What is claimed is:

1. A system for supporting the weight of a person, comprising:

a track;

a movable support unit operatively attached to the track, the movable support unit being movable along a path defined by the track in a first direction and in a second direction generally opposite to the first direction;

a first drive attached to the movable support unit, said first drive moving the support along the path defined by the track, wherein the first drive is frictionally coupled to a surface of the track to control a horizontal position of the movable support unit along the track;

an actuator attached to the movable support unit, said actuator including a second drive for driving a rotatable drum, said drum having a first end of a strap attached thereto and the strap wound in an overlapping coil fashion about an outer surface of the drum, and a second end of the strap being coupled to a support harness attached to support a person;

a first sensor configured to detect an amount of horizontal force applied to the movable support unit via the strap, wherein the first sensor includes a strap guide and a first load cell, said strap guide operatively attached to and extending downward from said movable support unit, a top end of said strap guide being attached to the first load cell in a manner causing a change in the first load cell output when the strap is pulled in a direction forward from or backward from a vertical by a person;

a second sensor configured to sense a vertical force applied to the strap, wherein the second sensor includes a second load cell and at least one pulley between the drum and the person supported by the strap, wherein the pulley is connected to one end of a pivoting arm, said arm being pivotally attached near its midsection to a frame member coupled to the movable support unit, and where an opposite end of said pivoting arm is operatively associated with the second load cell such that the second load is placed only in compression in response to a load suspended on the strap; and a control system configured to receive signals from the first sensor, the second sensor, and a user interface, and configured to control, in response to the received sensor, the movement of at least the first and second drives to facilitate the support during movement of the person, where the control system dynamically adjusts the amount of support provided to the person by moving the moveable support unit horizontally along the track to follow the person, and by dramatically altering, the vertical force applied to the person via the strap, the drum and the second drive.

2. The system according to claim 1, wherein said track includes a plurality of extruded members joined end-to-end, and a plurality of electrical rails along an interior portion of the track for each portion of track over which the movable support unit travels.

3. The system according to claim 2, wherein said extrusion includes a generally planar upper surface, extending in a longitudinal direction; opposing sides extending longitudinally and downward from each side of the upper surface, wherein a combination the upper surface and downward-extending sides form the interior portion of the track; each of said opposing sides further including a shoulder extending in an outward direction therefrom.

4. The system according to claim 3, wherein said first drive is maintained in frictional contact with the interior portion of the track and where the movable support unit is suspended from rollers resting on each of the shoulders extending from the opposing sides of the track.

5. The system according to claim 4, wherein the movable support unit further includes biased idler wheels for restraining a position of the movable support unit along a longitudinal axis of the track.

6. The system according to claim 5, wherein the first drive is slidably connected to the movable support, along a direction generally perpendicular to the longitudinal axis of the track.

7. The system according to claim 3, further including at least one enclosed channel extending an entire length of each of the downward-extending sides.

8. The system according to claim 2, wherein said track includes internal T-slots for attachment of the rails via the internal T-slots.

9. The system according to claim 1, wherein said track includes at least one T-slot for insertion of a mounting component to facilitate mounting the track to a structure.

10. The system according to claim 1, further including a strap slack sensor, including a micro-switch adjacent a window in the strap guide, said micro-switch comprising a biased contactor in contact with the strap, wherein the contactor causes the micro-switch to change state whenever there is slack in the strap, and where the change in state is sensed by the control system such that an operation of the actuator is at least temporarily disabled upon detecting slack in the strap.

11. The system according to claim 1 further comprising: a plurality of indicators, operated by the control system, said indicators displaying an operational status of the system; and the user interface configured to display information from said control system, and receive information entered by a therapist to control an operation of the system.

12. A system for supporting a person, comprising:

a track;

a movable support unit operatively attached to the track, the movable support unit being movable along a path defined by the track in a first direction and in a second direction generally opposite to the first direction;

a first drive attached to the movable support unit, said first drive moving the support along the path defined by the track, wherein the first drive is frictionally coupled to a surface of the track to control a horizontal position of the movable support unit along the track;

an actuator attached to the movable support unit, said actuator including a second drive for driving a rotatable drum, said drum having a first end of a strap attached thereto and the strap wound in an overlapping coil fashion about an outer surface of the drum, and a second end of the strap being coupled to a support harness attached to support a person;

a first sensor configured to detect an amount of horizontal force applied to the movable support unit via the strap;

a second sensor configured to sense a vertical force applied to the strap, wherein the second sensor includes a load cell and at least one pulley between the drum and the person supported by the strap, wherein the pulley is connected to one end of a pivoting arm, said arm being pivotally attached near its midsection to a frame member coupled to the movable support unit, and where an opposite end of said pivoting arm is operatively associated with the load cell such that the load cell is placed only in compression in response to a load suspended on the strap; and a control system configured to receive signals from the first sensor, the second sensor, and a user interface, and configured to control, in response to the received signals, the movement of at least the first and second drives to facilitate the support during movement of the person, where the control system dynamically adjusts the amount of support provided to the person by moving the moveable support unit horizontally along the track to follow the person, and by altering, the vertical force applied to the person via the strap, the drum and the second drive.

13. The system according to claim 12, wherein the system includes a database for storing information relative to the operation of the system and where the user interface further displays information selected from the group consisting of: a patient record window; a day list window showing use of the system; a plan of care selection window; and a session data window.

14. A system for supporting the weight of a person, comprising:

a track including a plurality of extruded members joined end-to-end, and a plurality of electrical rails arranged longitudinally along an interior portion of the track for each portion of track, wherein at least one extruded member includes a generally planar upper surface extending in a longitudinal direction, opposing sides extending longitudinally and downward from each side of the upper surface, and where a combination the upper surface and downward-extending sides form the interior portion of the track; each of said opposing sides further including a shoulder extending in an outward direction therefrom;

a movable support unit operatively attached to the track, the movable support unit being movable along a path defined by the track in a first direction and in a second direction generally opposite to the first direction;

a first drive attached to the movable support unit, said first drive moving the support along the path defined by the track, wherein the first drive is frictionally coupled to a surface of the track to control a horizontal position of the movable support unit along the track, wherein said first drive is maintained in frictional contact with the interior portion of the track and where the movable support unit is suspended from rollers resting on each of the shoulders extending from the opposing sides of the track;

an actuator attached to the movable support unit, said actuator including a second drive for driving a rotatable drum, said drum having a first end of a strap attached thereto and the strap wound in an overlapping coil fashion about an outer surface of the drum, and a second end of the strap being coupled to a support harness attached to support a person;

a first sensor configured to detect an amount of horizontal force applied to the movable support unit via the strap, wherein the first sensor includes a strap guide and a first load cell, said strap guide operatively attached to and extending downward from said movable support unit, a to end of said strap guide being attached to the first load cell in a manner causing a change in the first load cell output when the strap is pulled in a direction forward from or backward from vertical by the person;

a second sensor configured to sense a vertical force applied to the strap, wherein said second sensor includes a second load cell and at least one pulley between the drum and the person supported by the strap, wherein the pulley is connected on one end of a pivoting arm, said arm being pivotally attached near its midsection to a frame member coupled to the movable support unit, and where an opposite end of said pivoting arm is operatively associated with the second load cell such that the second load cell is placed only in compression in response to a load suspended on the strap; and a control system configured to receive signals from the first sensor, the second sensor, and a user interface, and configured to control, in response to the received signals, the movement of at least the first and second drives to facilitate the support during movement of the person, where the control system dynamically adjusts the amount of support provided to the person by moving the moveable support unit horizontally along the track to follow the person, and by altering the vertical force applied to the person via the strap, the drum and the second drive.

15. The system according to claim 14, further comprising: a plurality of indicators, operated by the control system, said indicators displaying an operational status of the system; and the user interface configured to display information from said control system, and receive information entered by a therapist to control an operation of the system.

16. The system according to claim 15, wherein the system includes a database for storing information relative to the operation of the system and where the user interface further displays information selected from the group consisting of: a patient record window; a day list window showing use of the system; a plan of care selection window; and a session data window.

17. A method for supporting the weight of a person for purposes of rehabilitation therapy, comprising:

providing a track, the track including a plurality of extruded members joined end-to-end, and a plurality of electrical rails arranged longitudinally along an interior portion of the track for each portion of track, wherein at least one extruded member includes a generally planar upper surface extending in a longitudinal direction, opposing sides extending longitudinally and downward from each side of the upper surface, and where a combination of the upper surface and downward-extending sides form the interior portion of the track; each of said opposing sides further including a shoulder extending in an outward direction therefrom;

operatively attaching a movable support unit to the track, the movable support unit being movable along a path defined by the track in a first direction and in a second direction generally opposite to the first direction;

moving the movable support unit along the path defined by the track using a first drive attached to the movable support unit, wherein the first drive is operatively coupled to a surface of the track to control a horizontal position of the support along the track, and where the movable support unit is suspended from rollers resting on each of the shoulders extending from the opposing sides of the track;

controlling a vertical position of a person using an actuator attached to the movable support unit, said actuator including a second drive for driving a rotatable drum, said drum having a first end of a strap attached thereto and the strap wound in an overlapping coil fashion about an outer surface of the drum, and a second end of the strap being coupled to a support harness attached to support the person;

detecting an amount of horizontal force applied to the movable support unit via the strap using a first sensor, the first sensor including a strap guide and a first load cell, said strap guide operatively attached to and extending downward from the movable support unit, a top end of the strap guide being attached to the first load cell in a manner causing a change in the first load cell output when the strap is pulled in a direction forward from or backward from vertical by the person;

sensing a vertical force applied to the strap using a second sensor, the second sensor including a second load cell and at least one pulley between the drum and the person supported by the strap, wherein the pulley is connected on one end of a pivoting arm, said pivoting arm being pivotally attached near its midsection to a frame member coupled to the movable support unit, and where an opposite end of said pivoting arm is operatively associated with the second load cell such that the second load cell is placed only in compression in response to a load suspended on the strap; and providing a control system configured to receive signals from the first sensor, the second sensor, and a user interface, and configured to control, in response to the received signals, the movement of at least the first and second drives to facilitate and support movement of the person, where the control system dynamically adjusts the amount of support provided to the person by moving the moveable support unit horizontally along the track to follow the person.

18. The method according to claim 17, wherein the controller is pre-programmed to control operation of the system in a manner to minimize any effect on the person while permitting movement of the person and dynamically sensing and preventing falls, and thereby altering the vertical force applied to the person via the strap, the drum and the second drive; and where the parameters for operation of the second drive are adjusted for the person.

* * * * *